United States Patent [19]

Ohkubo et al.

[11] 4,219,271

[45] Aug. 26, 1980

[54] IMAGE FORMNG METHOD AND DEVICE FOR CONTROLLING IMAGE DENSITY

[75] Inventors: Masharu Ohkubo, Kawasaki; Yujiro Ando, Yokohama; Toshio Honma, Tokyo; Shuji Murakawa, Yokohama; Katsumi Murakami, Kawasaki; Katsushi Furuichi, Yokohoma, all of Japan

[73] Assignee: Canon Kabushiki Kiasha, Tokyo, Japan

[21] Appl. No.: 888,878

[22] Filed: Mar. 22, 1978

[30] Foreign Application Priority Data

| | | |
|---|---|---|
| Mar. 26, 1977 | [JP] Japan | 52-33839 |
| Mar. 26, 1977 | [JP] Japan | 52-33840 |
| Mar. 26, 1977 | [JP] Japan | 52-33841 |
| April 26, 1977 | [JP] Japan | 52-48243 |

[51] Int. Cl.[2] ..... G03G 15/00

[52] U.S. Cl. ..... 355/14 R; 355/3 SC; 355/3 DD; 355/14 D; 355/14 TR; 430/30; 430/54

[58] Field of Search ..... 355/14, 3 SC, 3 CH, 355/3 DD, 109; 118/7, 646; 96/1 R

[56] References Cited

U.S. PATENT DOCUMENTS 4,026,643 5/1977 Bergman ..... 355/14 X

*Primary Examiner*—R. L. Moses

*Attorney, Agent, or Firm*—Fitzpatrick, Cella, Harper & Scinto

[57] ABSTRACT

Disclosed is an image forming apparatus of a type, in which there is provided first and second electrically chargeable members, a first processing device to form a primary electrostatic latent image on the first chargeable member, a second processing device to form a secondary electrostatic latent image of the second chargeable member in accordance with the primary electrostatic latent image, to develop the secondary electrostatic latent image, and to transfer the thus developed image onto an image transfer material. A detecting device is provided to detect the visible image forming capability of at least one of electrostatic latent images; and, a control device is provided, responsive to the detecting device, to control at least one of the first and second processing devices so as to form a developed image of a predetermined image density.

35 Claims, 31 Drawing Figures

+E
+E
iM
a
b
c
a
b
c
27
29
30
31
32
76
275
281
282
300
301
305
306
307
308
309
310
311
312
313
314
315
316
317
318
319
320
vc
vc
vI
vo

IMAGE FORMING METHOD AND DEVICE FOR CONTROLLING IMAGE DENSITY

BACKGROUND OF THE INVENTION a. Field of the Invention

This invention relates to a method and apparatus for forming a stable, satisfactory image on an image recording medium through the electrophotographic technique.

b. Description of the Prior Arts

As an electrophotographic technique, the image forming process defined in terms of the Carlson process, etc., has been widely known, in which an electrostatic latent image is formed on a photosensitive body made of an electrically conductive layer and a photoconductive layer in a laminar form. Also, another method and apparatus for forming such an electrostatic latent image, in which such image is formed by the use of a photosensitive screen having a multitude of tiny openings, have been disclosed in Japanese Patent Publication No. 50-18782 (U.S. Pat. No. 3,647,271) and a Laid-Open Japanese Patent Application No. 51-341 (U.S. Ser. No. 771,309).

With progress in the above-described electrophotographic technique, there have been developed process control techniques for stabilizing the obtained image. As an example, there is a method in which electric current caused by a corona discharger to charge the photosensitive body is detected, and the thus detected current is controlled to a constant level to thereby stabilize the electrostatic latent image in an indirect manner. In the case of using the photosensitive screen, there is such a method that an electrostatic latent image formed by modulation is rendered constant (Laid-Open Japanese Patent Application No. 51-1322). In these methods, it is important for obtaining the images in their optimum conditions to properly effect the detection and control of the electric current in conjunction with the actual image forming process cycle, although none of the disclosures that point.

For the modulating element which modulates ion current and charged toner particles, there have been known Japanese Patent Publications No. 47-33775 and No. 49-20094, in which an electrical signal is applied to an electrode in the form of an aperture board, etc.. These publications do not also mention anything about such important factors as appropriate detection and control of ion current and charged toner particles. In the case of using the photosensitive screen system, there is such a method that multiple modulations of the corona ion current is made possible with one and same primary electrostatic latent image formed on the screen, whereby multiple numbers of reproduction copies can be obtained. In the image forming technique using such screen, there inevitably takes place changes in the image quality with increase in the number of the modulation times. In order therefore to correct such changes and to form the reproduced images substantially free from such changes, a corrective device to vary the corona ion current for the secondary electrostatic latent image formation becomes necessary. For such corrective means, there can be contemplated a method, in which various conditions for the image formation is caused to vary in accordance with preset conditions based on the number of times for the ion current modulation. It is, however, practically difficult to correct the image changes to a sufficiently adequate state under the constant preset conditions due to various factors such as difference in the construction of the screen accompanied by its fabrication conditions, changes in the state of the screen owing to its state of use, and changes in the environment of the screen, and others. Further, when the ion current is modulated for multiple numbers of times by the use of the primary electrostatic latent image, there inevitably arises a limitation. It can therefore be contemplated that this number of times for the modulation is preset to be the limitation, and that a subsequent primary electrostatic latent image is reformed at a stage when this preset number of times for the modulation is reached. However, since the number of times for the modulation varies depending on the screen conditions, the number of the modulation times to be preset is slightly less than that practically possible. On account of this, there would occur such a situation that the modulation has to be terminated on the way, in spite of the fact that such modulation is still possible practically, and the primary electrostatic latent image should be reformed with the consequent decrease in the image forming speed.

In the electrophotographic technique, the electrostatic latent image which has been formed is developed with a developing agent, or developer. For the developer, there is used color particles called "toner". This toner is, in most cases, used in the form of a mixture with a carrier such as glass beads, iron powder, organic solvent, and so forth. In this developing system, since the mixing ratio between the toner and the carrier (hereinafter simply called "toner concentration") greatly affects the image quality, the control of the toner concentration constitutes one of the important techniques in the electrophotographic reproduction method. For the automatic control method of the toner concentration, there have been known the following: (1) a method, in which the toner concentration is measured, depending on excess or shortage of which a toner feeding mechanism is operated; and (2) a method, in which a quantity of the toner to be actually consumed is measured or estimated, and, depending on the actual consumption thereof, the toner is replenished. In the former method, however, there has so far been no satisfactory measuring expedient and the result of the measurement, when done, is lack in fidelity. For the latter, there has been known such a method that average density of the original image is measured, or another latent image separate from that for the image reproduction is formed, and then this separate latent image is developed to replenish an amount of the toner used for the development. In reality, however, this method is remote from its realization in consideration of the fatigue in the measuring means for the average density of the original image, and in the toner due to the development.

SUMMARY OF THE INVENTION

In view of the above-described various disadvantages inherent in the heretofore known techniques, it is a general object of the present invention to provide an improved method and apparatus for the image formation which have solved such problems and difficulties.

It is a primary object of the present invention to provide an improved method and apparatus for the image formation which accurately detects the state of an electrostatic latent image.

It is a secondary object of the present invention to provide an improved control system for effecting adequate image formation in accordance with a latent image as detected.

It is a third object of the present invention to provide an improved method for adequately correcting a secondary latent image which is to be formed at every time in the retention copying based on the primary latent image.

It is a fourth object of the present invention to provide an improved method for adequately correcting a developed image at every time in the retention copying.

It is a fifth object of the present invention to provide an improved method for re-forming the primary electrostatic latent image by appropriate discrimination of a limitation to be imposed on the retention copying.

The foregoing objects and other objects, as well as the actual construction and operation of the method and apparatus according to the present invention, will become more apparent and understandable from the following detailed description thereof, when read in connection with the accompanying drawings.

DESCRIPTION OF PREFERRED EMBODIMENTS

Figure 1:
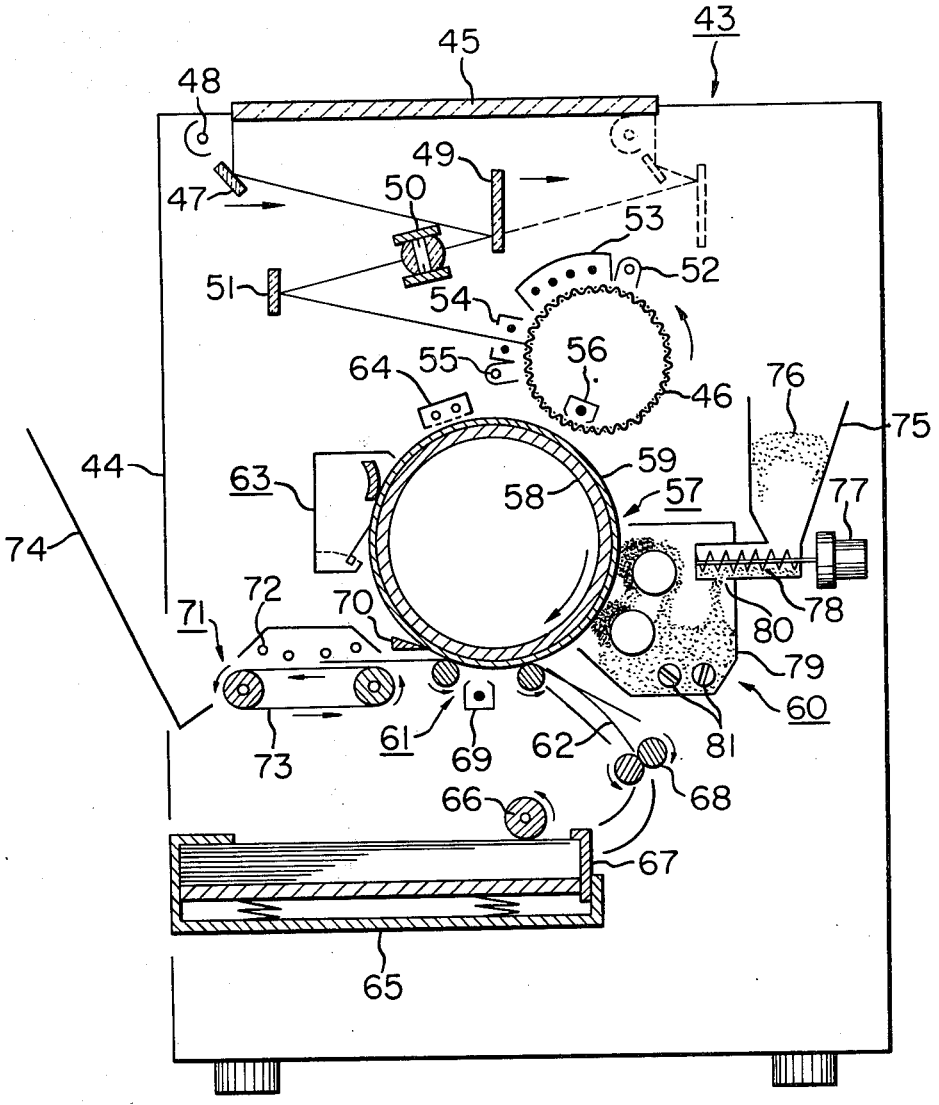
FIG. 1 is a cross-sectional view of a reproduction apparatus, to which the present invention can be applied.

The present invention is to control the image forming conditions (processing capability of the process means), in a method and an apparatus for obtaining a visible image, wherein a primary electrostatic latent image is formed on a chargeable member, then a secondary electrostatic latent image is formed in accordance with the primary electrostatic latent image, subsequently the secondary electrostatic latent image is developed, and, depending on necessity, the thus developed image is transferred onto an image transfer material, by a detected output obtained from detection of visibility in the electrostatic latent image so that a visible image of a predetermined density may be formed. For example, visibility (visible image forming capability) of the primary electrostatic latent image is detected, based on which detection the image forming conditions for the secondary electrostatic latent image forming and thenceforward are controlled.

Further, the present invention is to detect visibility of the initial electrostatic latent image formed on the chargeable member, hold a signal representing such visibility or a control signal corresponding to the visibility, and control at least one processing means such as the latent image formation, development, and image transfer, ect. in the process execution steps thenceforth by the hold signal and a fresh detection signal so that a visible image having a predetermined density may be obtained.

The present invention is, further, to detect any change in the ion current to control the image forming conditions, when the visible image is to be obtained by forming the electrostatic latent image with the modulated ion current.

Also, the present invention is to detect the visibility of the latent image to control supply of the developing agent so that a visible image of a predetermined density may be formed.

In the case of the photosensitive screen, for example, the ion current to flow through the screen can be detected accurately and easily, as the result of which an adequate image can be readily obtained by controlling the image forming conditions on the basis of the above-mentioned detected signal. Even when the modulation is repetitively carried out with one and same primary electrostatic latent image to effect the detection of the electric current caused by the ion current passing through the screen as mentioned above, there arises no necessity for presetting the number of repeating times. It is furthermore possible to carry out the constantly stable retention copying in utilization of the detected signal for the control of the image forming conditions. Moreover, since the corona ion current passing through the screen is developed as it is to form the secondary electrostatic latent image, the quantity of the developing agent to be consumed can be accurately estimated by measuring the quantity of the ion current passing through the screen. Consequently, in the case of the retention copying, an accurate quantity of the toner can be replenished, and the visible image having a predetermined density can always be obtained.

The term "image forming conditions" as used herein include corona discharge quantity and irradiating quantity of image light at the time of forming the primary electrostatic latent image, corona discharge quantity for correcting the primary electrostatic latent image potential, etc., and modulating corona discharge quantity at the time of forming the secondary electrostatic latent image, bias voltage at the time of forming the electrostatic latent image, corona discharge quantity for removing residual charge, bias voltage for development, bias voltage for image transfer, etc.. That is to say, the term is meant by those factors which give influence on the electrostatic latent image when it is to be formed.

In the preferred embodiments of the present invention to be described hereinbelow, the primary electrostatic latent image is meant by such an electrostatic latent image that is formed on the screen in accordance with the original image; the secondary electrostatic latent image is meant by such an electrostatic latent image that is formed on a chargeable member by modulating the ion current through the abovementioned primary electrostatic latent image; and the retention copying is meant by formation of the secondary electrostatic latent images over multiple numbers of times from one and same primary electrostatic latent image to obtain multiple numbers of reproduced and printed copies. Also, the chargeable member is meant by electrically chargeable materials in the form of sheet such as electrostatic recording paper, etc., and in an endless form such as insulating drum, etc., all these being generally called hereinafter "recording medium".

FIG. 1 shows a schematic construction, in cross-section, of the reproduction apparatus to form a reproduced image on a plane paper in utilization of a photosensitive screen and processing steps for the primary and secondary electrostatic latent image formations, development, and image transfer. In the drawing, a numeral 44 refers to an outer wall of the apparatus, and an original image to be reproduced such as literatures, documents, etc. is placed on an original mounting table 45 made of a transparent member such as glass, etc. provided on the top surface of the outer wall 44. This original mounting table 45 is of a fixed type, and the image irradiation to a screen 46 is effected by partial movement of the optical means. This optical means is a known one, in which a first mirror 47 and an original illuminating lamp 48 are caused to shift from their positions in solid lines to the rightmost positions in dash lines to cover the whole distance at a speed V. On the other hand, a second mirror 49 is caused to shift from its position in solid line to the rightmost position in dash line at a speed of V/2 simultaneously with movement of the first mirror 47 which scans the surface of the original image. The original image which has been led by the first and second mirrors 47, 49 is then introduced onto the screen 46 through a lens system 50 having an aperture mechanism and a fixed mirror 51. Incidentally, the abovementioned screen 46 is constructed in a drum shape so that the electrically conductive member exposed outside may face inward. In the vicinity of the screen 46, there is disposed a latent image forming means along the rotational direction of the screen 46. A reference numeral 52 designates a preexposure lamp which is provided for using the photoconductive member constituting the screen 46 in a constantly stable photo-hysteresis state. A numeral 53 refers to a corona discharger which is the primary voltage applying means, and charges the rotating screen 46 to a sufficient voltage level. A numeral 54 designates another corona discharger which is the secondary voltage applying means, and irradiates the original image, while removing electric charge on the screen 46 due to the abovementioned corona discharger 53. On account of this, the corona discharger 54 has such a construction that a shield plate at the back surface thereof is optically open. 55 denotes a lamp for overall image irradiation, which uniformly irradiates the screen 46 to quickly increase an electrostatic contrast of the primary electrostatic latent image. Thus, through operations of the above-described processing means, the primary electrostatic latent image of high electrostatic contrast is formed on the screen 46 during its rotation. Then, corona ion from a corona discharger 56 is modulated by the primary electrostatic latent image on the screen 46, and the secondary electrostatic latent image is formed on an insulated drum 57 rotating in the direction of an arrow mark. The insulated drum 57 is so constructed that an electrically conductive substrate 58 is covered with an insulating layer 59. In such construction of the insulated drum, a voltage is applied across the electrically conductive substrate and the electrically conductive member of the screen 46 to lead the modulated corona ion to the surface of the insulating layer 59. The secondary electrostatic latent image thus formed on the insulating layer 59 is developed by a developing means 60 to become a toner image. The toner image is, thereafter, transferred to an image transfer material 62 which has been conveyed to an image transfer position in synchronism with the toner image. The insulated drum 57 which has completed the image transfer step is cleaned by a known type of cleaning means 37 to remove residual toner on the insulating layer 59, and further rendered by a corona discharger 64 to have a uniform surface potential in preparation for the subsequent reproduction step.

Figure 10:
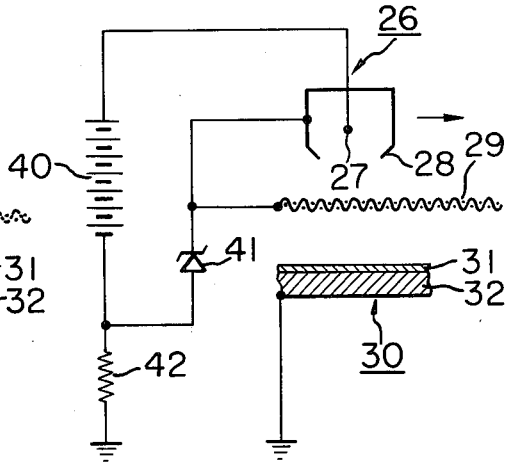

For the developing means 60, either a dry type or a wet type may be used. Also, for the cleaning means 63, various types such as blade type, brush type, etc. may be employed. On the other hand, the image transfer material 62 to be conveyed to the image transfer position 61 is loaded in a storage cassette 65, which is separated and fed one by one by means of a forwarding roller 66 and a separating pawl 67. The image transfer material is conveyed in such a manner that the edge of the transfer image and the edge of the toner image may be coincided by a register roller 68. In the drawing, a reference numeral 69 designates a corona discharger for image transfer, which is for applying a bias voltage to the image transfer material 62 at the time of transfer of the toner image so as to quicken the image transfer. After the image transfer, the transfer material 62 is separated from the insulated drum 57 by a separating pawl 70 and forwarded to an image fixing means 71 where it is subjected to image fixation by a heater 72, after which it is conveyed to a receiving tray 74 for finished image transfer material by means of a conveying belt 73. In the case of effecting the retention copying, the aforedescribed operations of the optical system for the primary electrostatic latent image formation is not performed, but only the process steps after the secondary electrostatic latent image formation can be done, hence the rotational speed of the screen can be increased. In the above-described apparatus, if there takes place changes in the primary electrostatic latent image on the screen 46 during the retention copying, such changes in the primary electrostatic latent image are detected by changes in the corona ion current from the corona discharger 56 passing through the screen 46. The detecting means is a circuit as shown in FIG. 10. The image quality of the reproduced copy is always kept constant by the use of this detected signal, for example, by increasing the voltage to be applied to the discharger 56, or decreasing the same. As soon as the use of the primary electrostatic latent image reaches its limit during the retention copying, the reproduction operation is interrupted and a fresh primary electrostatic latent image is re-formed, after which preparation of the remaining numbers of the predetermined reproduction copies begins again.

In the following, a toner feeding means for the abovementioned developing means 60 will be explained. In the drawing, supply of the toner to be consumed in the developing step is carried out by conveying the toner 76 within a toner storing vessel 75 by means of a screw 78 to be driven by a motor 77, and then dropping the conveyed toner into a toner storing vessel 79 for the developing means 60 through an opening 80 formed on its top portion. In the above-described construction, the toner which has been introduced into the toner receiving vessel 79 is sufficiently mixed with the developing agent in use by a pair of agitating screws, after which it is served for the developing process. Incidentally, the motor 77 rotates in accordance with an output obtained by detecting the corona ion current passing through the screen.

Figure 2:
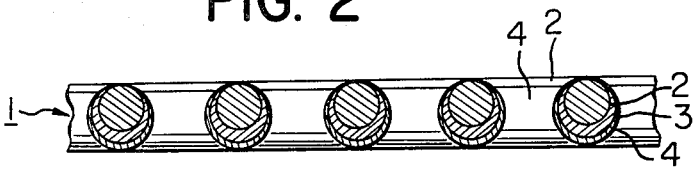
FIG. 2 is an enlarged, partial cross-sectional view of a screen used in various embodiments of the present invention.

FIG. 2 shows one embodiment of the photosensitive screen for use in the present invention, the illustrated construction being in an enlarged, schematic cross-section. In the drawing, the screen 1 is so fabricated that an electrically conductive member 2 having a multitude of tiny openings such as metal wire net, etc. is coated with a photoconductive member 3 in a manner to expose the electrically conductive member 2 to outside at one surface side, and with an insulating member 4 on the surface of the photoconductive member 3, all being in laminar form.

FIGS. 3 to 6 indicate one example of the electrostatic latent image forming process by the use of the screen 1, the detailed explanations of which are dispensed with. Here, explanations will be given with a case, as an example, wherein the screen used has such a characteristic that the hole is injected into the photoconductive member of the screen. That is to say, the photoconductive member 3 in the drawing, is assumed to be a semiconductor material such as selenium (Se) and its alloys, etc. with the hole as the principal carrier.

Figure 3:
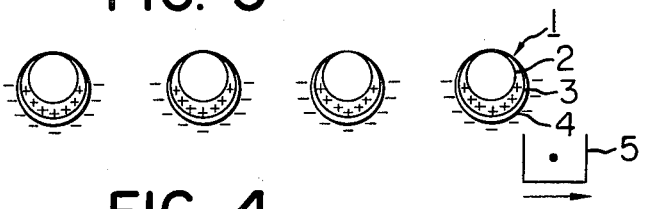
FIGS. 3 to 5 are, respectively, explanatory views for the primary electrostatic latent image formation by the use of the screen shown in FIG. 2.

FIG. 3 shows a result of the primary voltage application, in which the insulating member on the screen 1 is uniformly charged in the negative polarity (or positive polarity) by means of a known charging means. By this electric charging, the hole (or electron) is injected into the photoconductive member 3 through the electrically conductive member 2, and captured at the interface in the vicinity of the insulating member 4. In the drawing, a reference numeral 5 designates a corona discharger.

Figure 4:
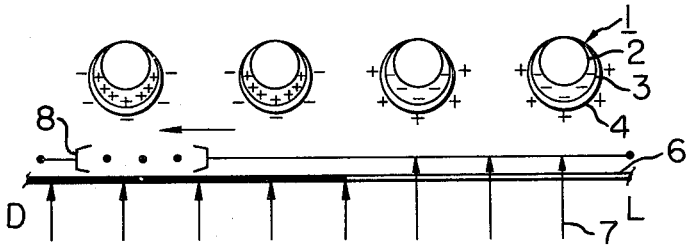

FIG. 4 shows a result of the secondary voltage application and the image irradiation effected simultaneously after the primary voltage application, in which there is used a corona discharge with a voltage composed of an a.c. voltage and a positive bias voltage superposed on the a.c. voltage, as the power source. The voltage to be applied, besides the a.c. voltage, may be a d.c. voltage in the opposite polarity to that of the abovementioned primary voltage. Also, in case the dark attenuation characteristic of the photoconductive member 3 is slow, the abovementioned voltage application and irradiation can be done not only simultaneously, but also sequentially. In the drawing, a reference numeral 6 designates an original image, a reference letter L a bright portion of the image, and D a dark portion thereof, a reference numeral 7 designates light rays, and 8 denotes a corona discharger.

Figure 5:
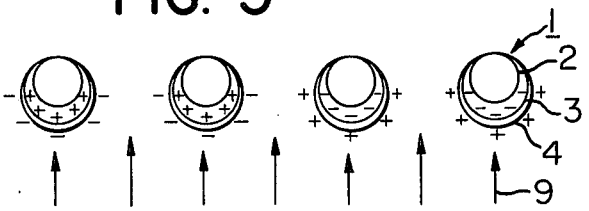

FIG. 5 shows a result of the overall irradiation effected on the screen 1 after the above-described processes, in which the surface potential of the screen 1 rapidly changes to a potential proportional to the surface charge quantity of the insulating member 4 to thereby form the primary electrostatic latent image. In the drawing, a reference numeral 9 designates light rays from the lamp.

Figure 6:
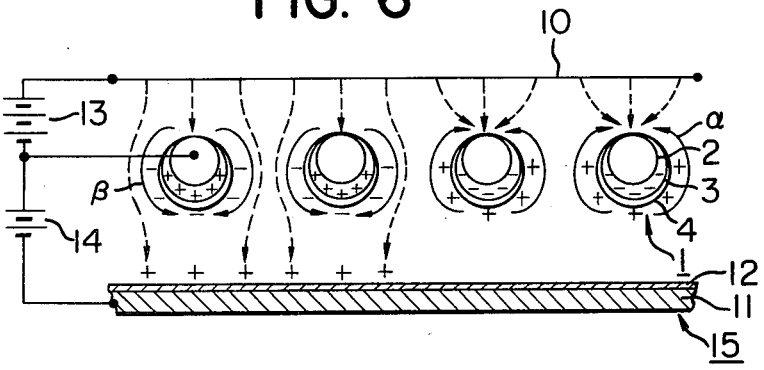
FIG. 6 is an explanatory view for the secondary electrostatic latent image formation by the use of the screen shown in FIG. 2.

FIG. 6 shows a state, in which ion current is modulated by the primary electrostatic latent image so as to form the secondary electrostatic latent image to be the basis for forming a positive image of the original on the recording medium. In the drawing, a numeral 10 refers to a corona wire for the discharger, 15 to a recording medium which consists of an insulating layer 12 to hold electric charge thereon and an electrically conductive substrate 11. Reference numerals 13 and 14 designate power sources which form electric fields in the direction where the corona ion flows across the corona wire and the reproduction paper 12. The recording medium 15 is disposed in proximity to the side of the insulating member 4 of the screen 1 so that the ion current from the corona wire 10 disposed through the screen 1 may be applied to the recording medium 15 in utilization of a potential difference between the corona wire 10 and the electrically conductive substrate 11. At this time, due to the primary electrostatic latent image charge on the screen 1, an electric field to inhibit the ion current shown by a solid line $\alpha$ acts on the bright portion of the image, while an electric field which permits the ion current shown by a solid line $\beta$ acts on the dark portion thereof, whereby the secondary electrostatic latent image which is the positive image of the original is formed on the recording medium 15. Incidentally, when the screen 1 of the above-described construction is used, it becomes possible to increase the electrostatic contrast due to the electric charge quantity to a remarkably high degree, because the primary electrostatic latent image is formed on the insulating member. As it is further possible to reduce attenuation of the electrostatic latent image charge once formed as minimum as possible, the retention copying in more numbers of times than in the conventional reproduction apparatus becomes feasible. When the polarity of the power sources 13 and 14 in FIG. 6 is reversed, the negative ion passes through a region corresponding to the bright portion of the image, and a negative image is formed on the recording medium 15. Also, in the formation of the primary electrostatic latent image, when a semiconductor material such as cadmium sulfide (CdS) and zinc oxide (ZnO) with electrons as the principal carrier is used as the photoconductive material 3 of the screen 1 so that the electron may be injected even in the dark portion of the original image, the primary voltage application will naturally be carried out in the opposite polarity to that in the abovementioned case, and the voltage application at the time of the secondary electrostatic latent image formation is also done in the opposite polarity. The process in that case is shown in FIGS. 2 to 7 with the polarity of the charge and the voltage applying source being reversed.

Figure 7:
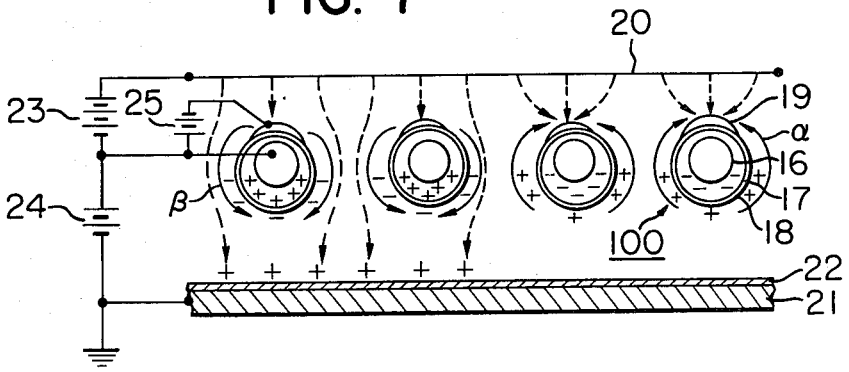
FIG. 7 is also an explanatory view of the secondary electrostatic latent image formation by the use of another type of screen.

FIG. 7 shows the secondary electrostatic latent image forming process, in which a screen 100 of a different construction from that shown in FIG. 2 is used. It should be noted that the primary electrostatic latent image formation can be done by the same process, in which the screen shown in FIG. 2 is used. In the drawing, a reference numeral 16 designates an electrically conductive member, 17 refers to a photoconductive member, 18 denotes an insulating member which coats the abovementioned members 16 and 17 in a manner to wrap them around, and 19 refers to an electrically conductive member for a bias electrode provided on one surface side of the screen 100, the member being electrically connected with the electrically conductive member 16 at the time of the primary electrostatic latent image formation. Further, a reference numeral 20 designates a corona wire, a numeral 21 refers to an electrically conductive base member, 22 denotes an insulating layer, and 23, 24, and 25 designate, respectively power sources. Incidentally, when a bias electric field is provided between the electrically conductive members 16 and 19, both of which are formed by vacuum-evaporative deposition of a metal or spray of electrically conductive paint, as in the screen 100 shown in FIG. 7, fine adjustment of an accelerating and inhibiting field for the ion current becomes possible. For example, when the negative bias voltage is increased in the electrically conductive member 19 as shown in FIG. 7, the corona ion current flows into the member 19 to cause extinction of the fogging phenomenon due to the charge and of the low image density area, and to further cause decrease in the overall image density.

In the following, explanations will be given in reference to FIGS. 8 to 10 as to embodiments, in which electric current passing through the screen is detected by the use of the abovementioned screen 100. In the illustrated embodiments, a screen 29 is so disposed that the surface side thereof where the electrically conductive member is exposed, or the side of the electrically conductive member for bias voltage application may be faced to the side of a modulating corona discharger 26. The screen 29 and the corona discharger 26 are made relatively movable, i.e., by rotation of the drum screen as shown in FIG. 1, or by slide-shifting of the planar screen and a corona charger in a mutually opposite direction.

Figure 8:
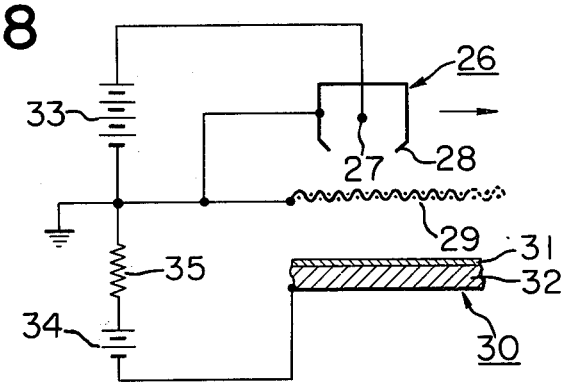
FIGS. 8 to 10 are, respectively, wiring diagrams for measuring corona ion current passing through the screen.

FIG. 8 shows one embodiment, wherein the screen 29 is grounded. When the modulating corona ion current is generated from the corona discharger 26, a portion of the generated corona ion current flows toward a shield plate 28 of the corona discharger 26, while the other portion thereof flows toward the screen 29, and the remaining portion thereof passes through the screen 29. The ion current which has passed through the screen flows toward a recording medium 30, to which a voltage is applied from a bias power source 34 to the screen, to thereby form the secondary electrostatic latent image on the surface of the recording medium 30. When the side of a corona discharge electrode 27 of the shield plate 28 is coated with the insulating member, there is no inflow of the ion current to the shield plate 28. In the above-described circuit construction, when an element for detecting electric current such as a resistor 35, etc. is inserted between the earth section and the screen bias power source 34, the electric current flowing through the resistor 35 remains to be only the current passing through the screen 29. This signifies that the electric current which has flown into the screen 29 or the shield plate 28 has been removed. In other words, by measuring the potential of the abovementioned resistor 35, it becomes possible to measure the electric current which actually works to form the secondary electrostatic latent image. Incidentally, a reference numeral 31 in the drawing designates an insulating layer, 32 refers to an electrically conductive base, and 33 denotes a power source for the corona discharge electrode.

Figure 9:
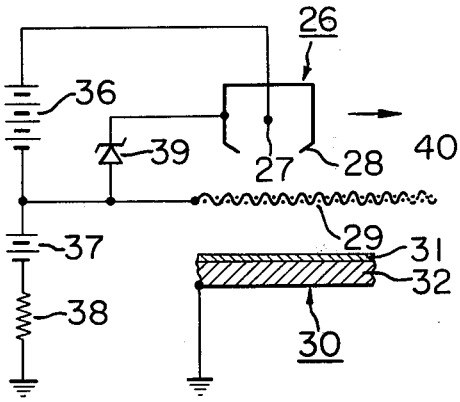

FIG. 9 shows another embodiment, in which a bias voltage is applied to the screen 29 and the recording medium 30 is earthed. In this embodiment, the element 38 to detect electric current passing through the screen may also be provided to the earth's side with respect to the bias power source 37 for the screen. In the drawing, a constant voltage element 39 inserted between the shield plate 28 and the screen 29 may be provided when it is necessary to cause a potential difference between the shield plate 28 and the screen 29. Presence of such element 39 does not affect at all the measurement of the abovementioned electric current. In the drawing, a reference numeral 36 indicates a power source for the corona discharge electrode. It should be noted that the same members as those in FIG. 8 are designated by the same reference numerals. It should also be noted that the same explanations hold true, even when the detecting element 38 and the earth's side of the electrically conductive base 32 are electrically connected directly by a lead wire.

FIG. 10 shows still another embodiment, in which the bias voltage for the screen is formed by a constant voltage element 41 or a resistance element 42, without using the bias power sources 34 and 37 for the screen as mentioned above. The detected signal can be taken out by an electrode which slides, by the rotation of the screen drum, on a slip ring connected to the screen. According to such wiring, it is also possible to measure the electric current caused by ion current passing through the screen. That is, by detection and measurement of the electric current, it becomes possible to find a state of the secondary electrostatic latent image, while carrying out simultaneously the ordinary image formation. In order to measure the electric charge quantity of the secondary electrostatic latent image, it may be feasible to cause the electrically conductive base of the recording medium to float so as to measure the current flowing in the base body. As stated in the foregoing, there are various physical methods for controlling the state of the secondary electrostatic latent image which has been detected substantially. Effective utilization of such methods will now be described hereinbelow.

The first effective utilization is to prevent image changes from taking place during the retention copying. In more detail, the secondary electrostatic latent image at the initial modulation is stored in a memory element, and thereafter when it has undergone changes with increase in the number of modulation times, the image forming conditions may be controlled in such a manner that the latent image is in the same state as at the initial stage when it was stored in the memory element. It is not, of course, necessary that a value measured at the time of the retention copying be made perfectly identical with the initially measured value. Depending on situation, better results can be obtained by changing only a predetermined value from the expected value in accordance with the number of times for the retention copying. For the measured value to be stored initially, there may be either an integrated value of electric current used in forming the secondary electrostatic latent image which was used for the image formation shown in FIG. 1, or peak values to be taken at the time of the electrostatic latent image formation, or mean value thereof. By the way, depending on the screen, the first formed secondary electrostatic latent image is not always the best in its condition. In such a case, the number of modulation times for the secondary electrostatic latent image formation to be stored may be such that the primary electrostatic latent image is maintained in a more stabilized condition during the repetitive operation. For the other example of the value to be stored in the memory element, it may also be contemplated such a combination that a value taken after several or several tens of the modulation times, within which the image conditions are stable, is used, and the initial image forming conditions is varied in accordance with the pre-established program. For the image forming conditions to be changed, for example, a quantity of the corona ion current flowing from the modulating corona discharger to the screen may be effectively changed. In order to achieve this, a voltage to be applied to the modulating corona discharger or a voltage at the side of the recording medium may be changed, or an opening width of the corona discharger or a distance between the corona discharge electrode and the screen may be changed. Means such as changing a voltage to be applied to the shield plate 28 of the corona discharger or to the bias power source 37 of the screen, etc., as shown in FIG. 9, may also be effective. Furthermore, as shown in FIG. 7 above, when the screen provided with the electrically conductive member 19 of the bias polarity is used, the applying voltage to the electrically conductive member 19 may be changed.

In the foregoing, a method of maintaining the secondary electrostatic latent image constant has been described. It is also possible, however, that the retention copying be carried out with the minimum changes in the secondary electrostatic latent image by forming the secondary electrostatic latent image under certain definite conditions, then detecting changes in the thus formed secondary electrostatic latent image through measurement of electric current caused by the abovementioned passing ion current, and, based on the detected results, controlling the image forming conditions after the modulation such as, for example, the bias voltage of the developing electrode, etc..

While it is possible to bring the image condition to be obtained from the retention copying by the abovementioned expedient to a constantly definite state, when the number of the retention copying times increases to 50 to 100 sheets or more at a time, there occurs such a situation that the image changes are unavoidable in whatever manner the abovementioned image forming conditions are established. Also, when the image forming conditions are established by the voltage increase, there arises such apprehension that change in capacity of the power source, occurrence of spark discharge between the component members, and so forth may arise at the high tension side. On account of this, there is eventually imposed a limitation, within which the voltage increase is permitted, when the voltage is to be increased, which makes it necessary to preset such a critical voltage within the circuit for controlling the image forming conditions. In other expedients, also, there exists a certain limit, within which the correction is allowed. Therefore, the possible number of times for the retention copying is usually estimated at a slightly lower value than that desired, and, when the number of the retention copying times have been reached, the operations is interrupted to re-form the primary electrostatic latent image. However, in the case of the present invention, wherein the forming condition of the secondary electrostatic latent image can always be detected, it becomes possible to automatically re-form the primary electrostatic latent image without presetting the possible number of retention copying times as mentioned above, but by setting a point as the critical number of the retention copying times, when, for example, the secondary electrostatic latent image has lowered its image quality for a certain ratio, say, 20%. In so doing, it becomes possible to effect the retention copying with a favorable image quality and at the maximum possible number of copying times, although the number of copying times may vary depending on the fatigue condition and the environmental condition of the screen, even if one and same original image is used.

The second effective use is to determine whether the detected secondary electrostatic latent image is in an appropriate condition, or not, the determined result of which is fed back to the forming conditions of the primary electrostatic latent image. In this case, as there takes place a delay in the image forming speed due to re-formation of the primary electrostatic latent image, a method can be contemplated, wherein control of the primary side is done prior to commencement of the image forming operation at the start of a day, or once every few hours, or further at the time of warming-up operation of the image forming apparatus.

In the above-described second use, too, it may also be feasible to obtain the optimum image without re-forming the primary electrostatic latent image, but by automatically changing the conditions for forming and developing the secondary electrostatic latent image. As a concrete method therefor, control is effected on a corona discharge voltage or a light quantity at the time of the image irradiation at the time of the primary electrostatic image formation, or a bias voltage, a corona discharge voltage, or a developing electrode voltage of the developer, etc. at the time of the secondary electrostatic latent image formation, thereby preventing the image to be ultimately obtained from any changes. In addition, the detection of the electric current is also capable of automatically discriminating abnormalities such as deterioration in the light source, disorders in the corona discharge device, and so on, hence such detection is highly effective. Also, instead of detecting the ion current from the discharger at the time of the secondary electrostatic latent image formation, a separate corona discharger may be provided to detect changes in the ion current thereby. Incidentally, there are various factors which affect the measured current value such as, for example, potential of the latent image, power of the corona discharger for the secondary electrostatic latent image formation, a bias voltage accelerating voltage, etc.. In such situation, when there is established several grades for an area having a definite density or concentration such as a white portion, a low density portion, an intermediate portion, and a high density portion, etc., and electric current corresponding to each portion is compared with a preset value by means of, for example, a pulse height analyzer, etc., it becomes possible to determine which factor can be varied. Moreover, as these factors are interrelated, the number of the factors to be varied can be reduced, whereby the purpose of the control may be limited to the prevention of the fogging phenomenon in the reproduced image, which is the most serious problem in this particular art. Incidentally, when electric current of the density level in several grades is detected to maintain the density constant, as described above, the intensity of the secondary voltage to be applied simultaneously with the image irradiation is increased with respect to current increase at the low density portion of the original image. Contrary to this, the intensity of the primary voltage is increased with respect to the current decrease at the high density portion of the original image. Furthermore, with respect to the current increase at the intermediate density portion, the latent image formation is carried out by opening the aperture wide to increase the exposure light quantity so that the current value at each density portion of the original image may be automatically controlled by assume a regulated value.

Since the electric current quantity and electric charge quantity which can be measured by the methods as described with reference to FIGS. 8 to 10 are proportional to the electric charge quantity to form the secondary electrostatic latent image, the toner quantity to be consumed by the development is substantially portion to the charge quantity due to the abovementioned measurement, although there occurs a difference to some extent due to an absolute value of the potential of the secondary electrostatic latent image, image conditions such as thin lines, solid black, etc.. Accordingly, if the toner is fed to the developing means in correspondence to the charge quantity due to the abovementioned measurement, the toner concentration of the developing agent in the developing means can always be maintained at a certain definite level. It is, of course, possible that not only the feeding quantity of the toner be made perfectly proportional to the charge quantity due to the ion current passed through the screen, but also it be made non-linearly correspondent thereto depending on the characteristic of the developing means. In case there exists an extremely small amount of electric current in the background portion, and the secondary electrostatic latent image due to the current cannot be developed for the image, it may be permissible that only current having a certain threshold value and above be made detectable. Or, it may be devised that where the toner consumption is low with an image having a solid black portion of large edging effect, the toner feeding quantity be not increased too high, even when the current quantity exceeds a certain definite level of the quantity. The toner feeding quantity to the passing current quantity depends on the developing means, the developing agent, or whether the residual toner after the image transfer, in case the reproduction apparatus is of such a type that uses plain paper, is to be re-used or not, the optimum value of which is determined empirically.

Actual methods for feeding the toner in correspondence to the charge quantity measured as mentioned above are many in kind, i.e., various mechanisms can be contemplated in accordance with the toner feeding means. While various methods for the toner feeding have been known, they can be classified broadly as follows: continuous feeding method, intermittent feeding method, constant quantity feeding method, and variable quantity feeding method. In the case of the feeding means wherein a solenoid, etc. is used to intermittently feed a definite quantity of the toner, there can be contemplated such a method that the charge quantity passing through the screen is integrated, the feeding means is actuated when the charge quantity reaches a certain definite value, the charge used for the abovementioned integration is simultaneously discharged, and, thereafter, the integration of the charge is restarted. The actual examples of the toner feeding method, in which the abovementioned integration is utilized, are such that the charge obtained by the abovementioned measurement is accumulated in a capacitor, or the charge obtained from the measurement is substituted for a pulse signal so as to count the pulse, and others. On the other hand, in the case of a mechanism where a grooved roller such as a screw, etc. is used, and the toner feeding speed is continuously varied by the number of revolution or rotational quantity of the roller member, such rotational member is constantly rotated at every formation of the secondary electrostatic latent image to make the number of revolution proportionate to the electric current passing through the screen, thereby attaining the purpose of the present invention. Also, it may be contemplated that a separate device for measuring the toner concentration based on various methods is provided so as to be used together with the roller member. For instance, the following method is considered effective for increasing general reliability, when combined with a toner concentration measuring means which cannot be said perfect in its performance. That is, the method is to change a relationship between the charge quantity passed through the screen and the toner feeding quantity based on the result obtained from the toner concentration measuring means, wherein, when the toner concentration is measured to be high, the toner feeding quantity to a certain definite charge quantity is reduced, and, conversely, when the toner concentration is measured to be low, the toner feeding quantity to a certain definite charge quantity is increased. By this method, even when the toner concentration measuring means becomes out of order, the minimum required quantity of the toner can be supplied without failure, and excessive feeding of the toner which renders the reproduced image to be inappropriate for practical use can be prevented.

Further, in an image forming apparatus incorporating therein a micro-computer, the practice of the present invention becomes easy owing to its operational and memory functions, and the methods of practice will be abundant. Besides the aforementioned examples of practice of the present invention, there can be contemplated various others such as, for example, a method, wherein an amount of electric current conducted during one image forming cycle is integrated, then calculation is performed to determine how many times this integrated value stands for a preset charge quantity, and the toner feeding means is operated for multiple numbers obtained from the calculation. For the method of operating the toner feeding means, there may be contemplated such one that the toner feeding means is pulse-driven as mentioned above, or by converting this multiple number to its operating time. The operational system due to a computer program control is also applicable in a case where the secondary electrostatic latent image forming conditions, etc. are controlled to predetermined conditions.

In the following, explanations will be given as to a control system which prevents changes in an image to be obtained by the retention copying based on the present invention, and which is capable of automatically determining the possible number of retention copying times in accordance with the condition of the screen per se, or a condition, under which the screen is placed, as well as a reproduction apparatus incorporating therein such control system.

Figure 11:
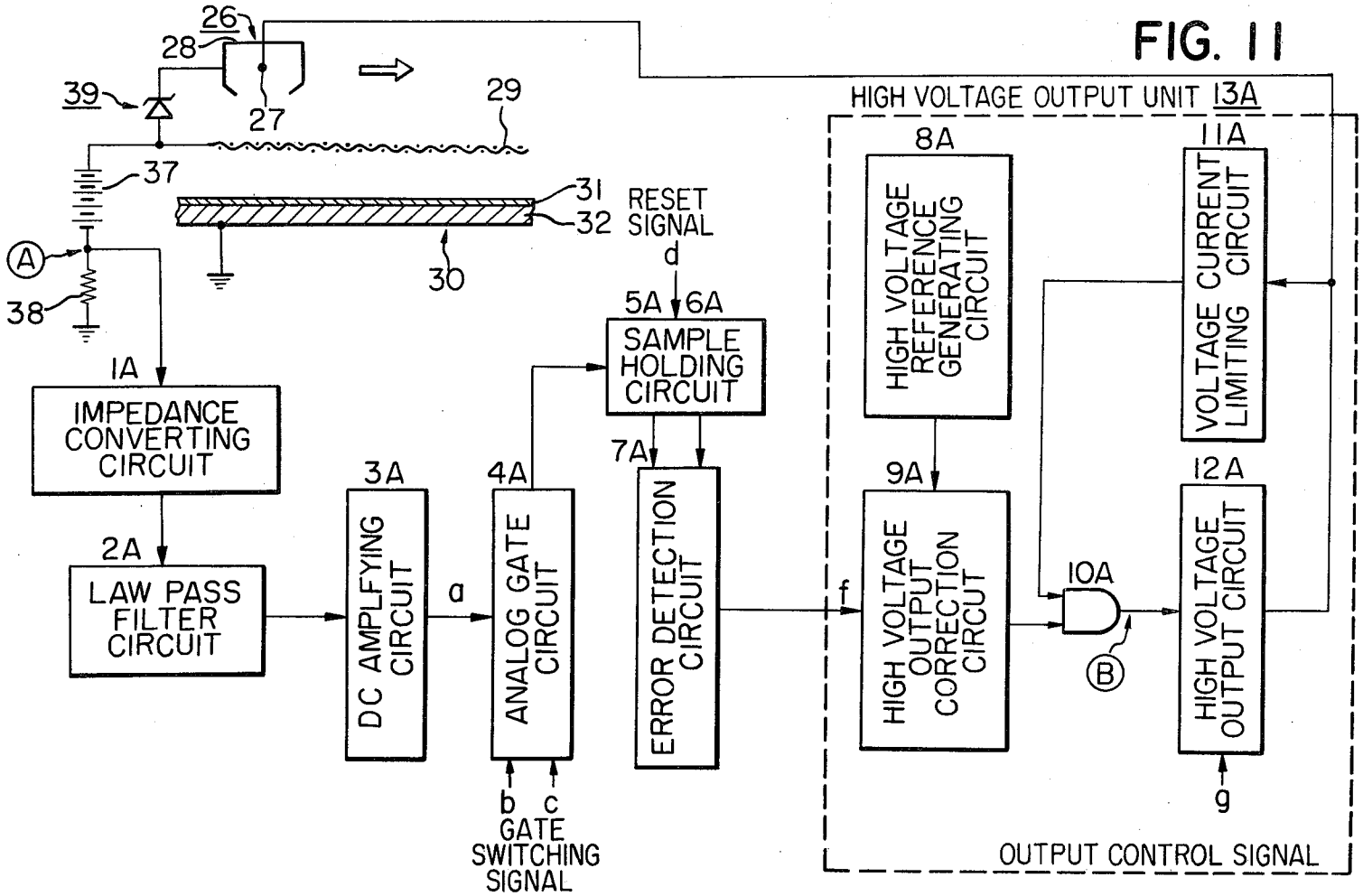
FIG. 11 is a control circuit diagram utilizing the present invention.
Figure 12:
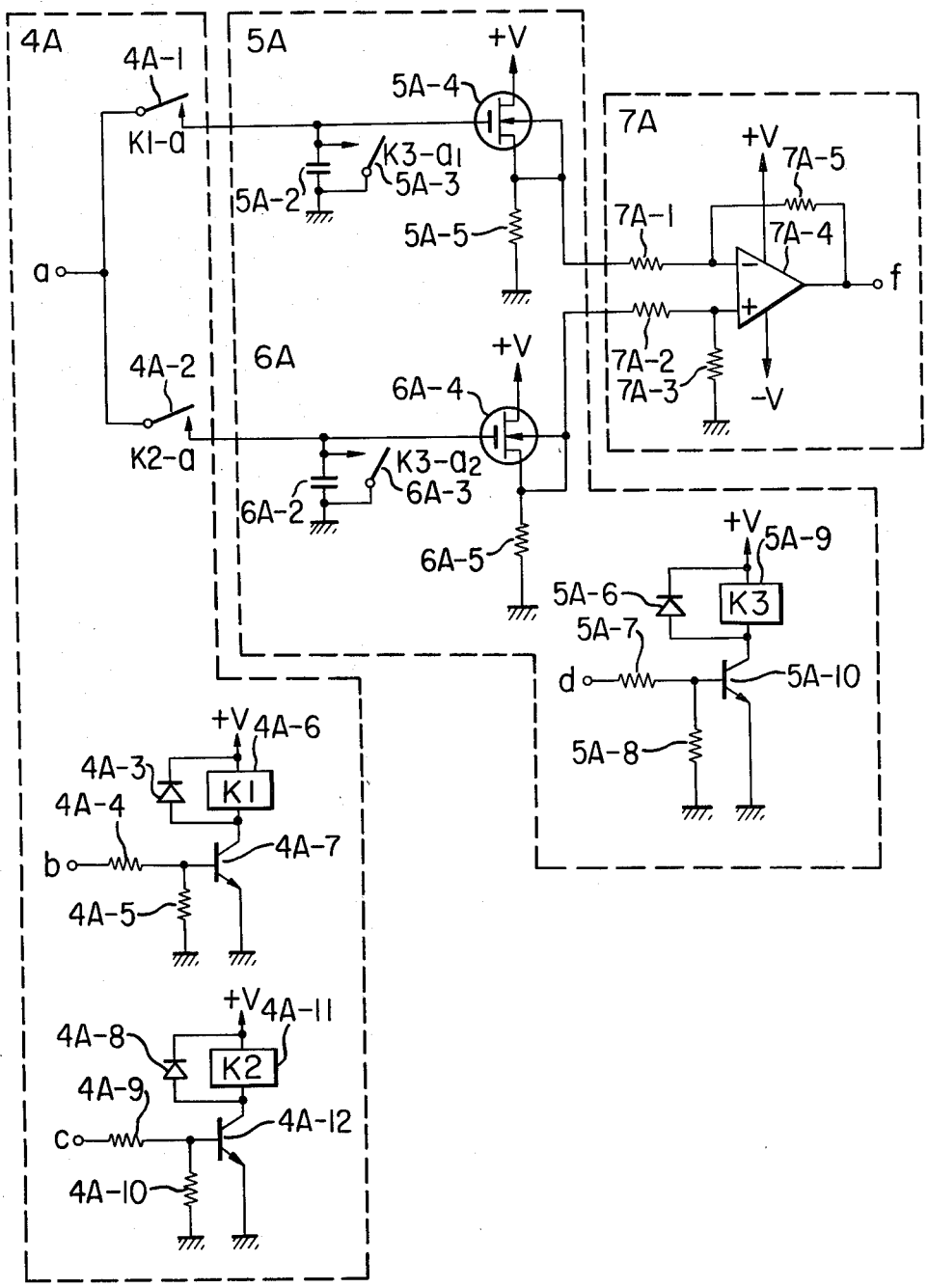
FIG. 12 is a wiring diagram for an error detection circuit.

FIG. 11 shows a circuit for a concrete means to effect a method according to the present invention, wherein the secondary electrostatic latent image at the time of the initial reproduction is stored, and then a high tension power source for the secondary electrostatic latent image formation is varied in such a manner that the secondary electrostatic latent image to be formed thereafter may be in the same state as that of the stored latent image. In this circuit, an element for detecting the corona current for form the secondary electrostatic latent image is placed in the position as explained in connection with FIG. 9. Also, a high tension power source 36 of the modulating corona discharger 26 is made the high tension power source, the output of which can be controlled by an input signal, as indicated by a high voltage output unit 13A in FIG. 11. Prior to explanation of the device as a whole, each circuit component will be explained at the outset. First, an impedance conversion circuit 1A in FIG. 11 is an ordinary voltage follower circuit which is used for impedance conversion so that no abnormality is given to the actual reproduction operation, when a voltage across the terminals of the resistance of a corona current detecting element 38 (hereinafter referred to simply as "resistance"). A low pass filter circuit 2A is of a very general type, and functions in such a way that the circuit may not bring about erroneous operations by noise, etc., in which only a regular signal of a voltage to be measured is transmitted to the subsequent stage, hence no specific wiring diagram is shown. A d.c. amplifying circuit 3A is for amplifying a voltage to be measured, which is very low in its tension, so that a circuit subsequent to this circuit may be easily operated for control. Since the circuit is of very general type, no specific wiring diagram is shown. An analog gate circuit 4A, sample and hold circuits 5A, 6A, and an error detection circuit 7A are interconnected in such a manner as shown in FIG. 12, the explanations of which will be given in the following. First of all, the analog gate circuit 4A is composed of two relays 4A-6 and 4A-11, and constantly opened contacts 4A-1 and 4A-2 of the respective relays. The circuit 4A controls transmission of a signal voltage at a point a in the drawing to the sample and hold circuits 5A and 6A. When a logic signal "1" to turn on a transistor 4A-7 is applied to a point b in the drawing, and the relay 4A-6 is excited, the contact 4A-1 is closed and the signal at the point a is transmitted to the subsequent circuit 5A. Similarly, when a logic signal "1" to turn on a transistor 4A-12 is applied to a point c, and the relay 4A-11 is excited, the contact 4A-2 is closed to transmit the signal at the point a to the subsequent circuit 6A. In the drawing, diodes 4A-3 and 4A-8 are, respectively, for absorbing reverse electromotive force caused by the relays 4A-6 and 4A-11 respectively. Also, reference numerals 4A-4, 4A-5, 4A-9, and 4A-10 respectively designate resistances. Next, the sample and hold circuit 5A consists of a capacitor 5A-2, an N-channel MOS FET 5A-4, a resistor 5A-5, a relay 5A-9, and a constantly opened contact 5A-3 for the relay. A sample signal is held in the capacitor 5A-2. The MOS FET 5A-4 takes a construction of a source follower circuit. A voltage proportionate to a gate voltage of the MOS FET 5A-4 appears across the terminals of the resistor 5A-5 connected to the source thereof. The signal which has been sampled and held in the capacitor 5A-2, i.e., charged voltage in the capacitor 5A-2, can be held therein over a long period of time, since the gate impedance of the MOS FET 5A-4 is very high. To reset this hold voltage, the constantly opened contact 5A-3 of the relay 5A-9 for short-circuiting the terminals of the capacitor 5A-3 may be closed, which can be achieved by applying a logic signal "1" to turn on a transistor 5A-10 at a point d in the drawing so as to excite the relay 5A-9. The sample and hold circuit 6A performs the exactly same operations as the sample and hold circuit 5A, hence any detailed explanations thereof will be dispensed with. Incidentally, a diode 5A-6 and the relay 5A-9 are same as 4A-3. Reference numerals 5A-7 and 5A-8 are respectively resistances. In the following, explanations will be given as to the error detection circuit. This circuit is composed of a differential amplifier using a general operational amplifier. When a source voltage $e_1$ of the MOS FET 5A-4 in the front stage is applied to a reverse input terminal of an operational amplifier 7A-4 through a resistor 7A-1, and a source voltage $e_2$ of the MOS FET 6A-4 in the front stage is applied to a non-reverse input terminal of the operational amplifier 7A-4 through a resistor 7A-2, there appears a voltage proportional to $(e_2-e_1)$ at a point f for an output terminal of the operational amplifier 7A-4 by selecting a value of the resistors in the circuit as (resistor 7A-1=resistor 7A-2) and (resistor 7A-3=resistor 7A-5).

Figure 13:
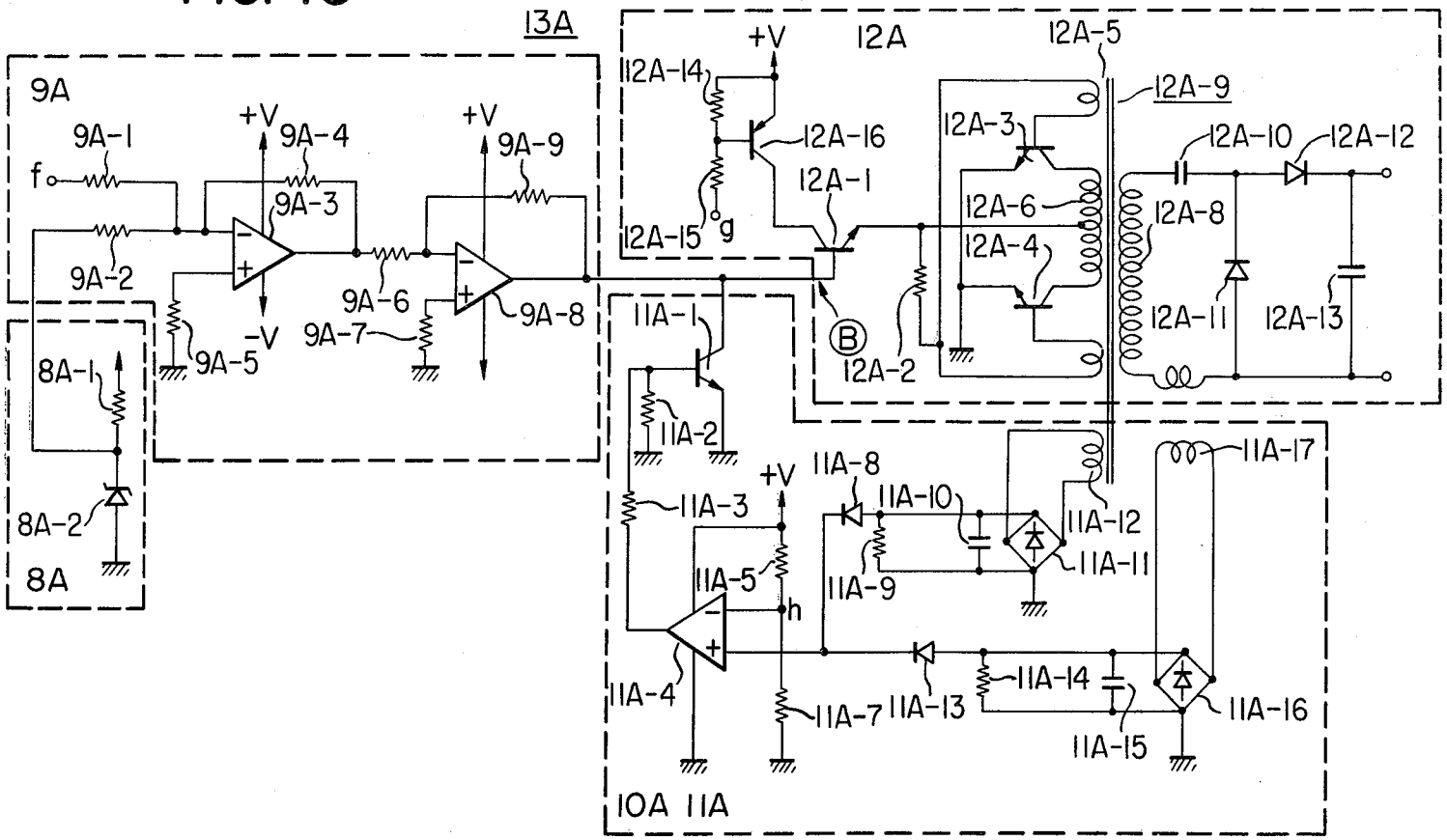
FIG. 13 is a wiring diagram for a reference value generating circuit.

Next, a high voltage output unit 13A will be explained, of which a reference value generating circuit 8A is first described in reference to FIG. 13. This circuit is constructed with a resistor 8A-1 and a constant voltage diode 8A-2, and produces a constant voltage to be determined by the constant voltage diode, as an output. Next, a high voltage output correcting circuit 9A will be explained. This circuit is composed of an addition circuit using an operational amplifier 9A-3 and a reverse amplifier circuit using an operational amplifier 9A-8. Signals to be added are an output $e_3$ of the high voltage reference value generating circuit 8A and an output $e_4$ of the error detecting circuit 7A (point f). These signals are applied to a reverse input terminal of the operational amplifier 9A-3 through the respective resistors 9A-1 and 9A-2. Here, by selecting a value of the resistor as (resistor 9A-1=resistor 9A-2), there appears at an output terminal of the operational amplifier 9A-3 a voltage which is proportional to $e_4+e_3$, and is reversed. In this circuit, a reference numeral 9A-5 designates a bias resistor of the non-reverse input terminal of the operational amplifier 9A-3, and a reference numeral 9A-4 indicates a feed-back resistor. Also, an output of the operational amplifier 9A-3 is applied to a reverse input terminal of the operational amplifier 9A-8 through a resistor 9A-6, and emerges at a output terminal as an amplified and reversed output. A numeral 9A-7 refers to a bias resistor for a non-reverse input terminal of the operational amplifier 9A-8, and a reference numeral 9A-9 a feed-back resistor.

A high voltage output circuit 12A consists of a dc—dc converter. In this circuit unit, there can be obtained across terminals of a high voltage output proportional to an emitter voltage of a transistor 12A-1 through a self-oscillating type converter section composed of transistors 12A-3, 12A-4, a resistor 12A-2, a base winding 12A-5, and a transformer 12A-9, and a multiple voltage rectifying circuit composed of capacitors 12A-10, 12A-13, and diodes 12A-11, 12A-12. Also, since the transistor 12A-1 takes a construction of an emitter follower 7A, a high voltage output can be made variable by varying its base voltage. The on-off control of the high voltage output depends upon whether a power source +V is connected with the converter section by the on-off operation of the transistor 12A-16 connected to the collector of the transistor 12A-1, or not. Accordingly, it is controlled by an output control signal entering into the base of the transistor 12A-16 as an input through the resistor 12A-15 (point g). A reference numeral 12A-14 designates a bias resistor for the transistor 12A-16. In the following, explanations will be given as to a voltage-current limiting circuits 10A, 11A. This circuit is composed of a voltage-current detection windings 11A-12, 11A-17 for a high voltage output, a comparator circuit including a rectifying circuit and an operational amplifier, and a transistor 11A-1 for intercepting the transistor 12A-1. A voltage appearing in the voltage detection winding is applied to a non-reverse input terminal of the operational amplifier 11A-4 through a diode 11A-18 after it is converted into a direct current by means of a diode bridge 11A-11 and a capacitor 11A-10. Similarly, a current of the high voltage output is converted into a voltage by means of the current detection windings, after which it is further converted into a direct current by a diode bridge 11A-16 and a capacitor 11A-15, and is finally applied to a non-reverse input terminal of an operational amplifier 11A-4 through a diode 11A-13. A non-reverse input terminal of an operational amplifier 11A-14 is applied with a voltage at a certain definite level resulted from division of the power source voltage +V by the resistors 11A-5 and 11A-7. When this voltage is maintained at a limit values of voltage and current for the high voltage output, a detected voltage level from the voltage detection winding 11A-12 and the current detection winding, which is to be applied to the non-reverse input terminal of the operational amplifier 11A-4, is lower than a voltage at a point h under a normal condition. Accordingly, the output from the operational amplifier 11A-4 is at a level of a logic signal "0" which does not turn on the transistor 11A-1. However, when the high voltage output exceeds the limit value in either the voltage or the current, the change is applied to the non-reverse input terminal of the operational amplifier 11A-14 through a diode 11A-8 or 11A-13. At this time, an output from the operational amplifier 11A-14 is reversed to a logic "1", the output of which turns on the transistor 11A-1 through the resistor 11A-3, while it turns off the high voltage output by intercepting the transistor 12A-1 in the high voltage output circuit 12A. Reference numerals 11A-9 and 11A-14 designate dummy resistors, and a numeral 11A-12 refers to a bias resistor for the transistor 11A-1. Here, it should be noted that, even when the transistor 11A-1 is turned on, an output from the operational amplifier 9A-8 connected to the collector is generally restricted its short-circuiting current, hence no problem arises at all.

Figure 14:
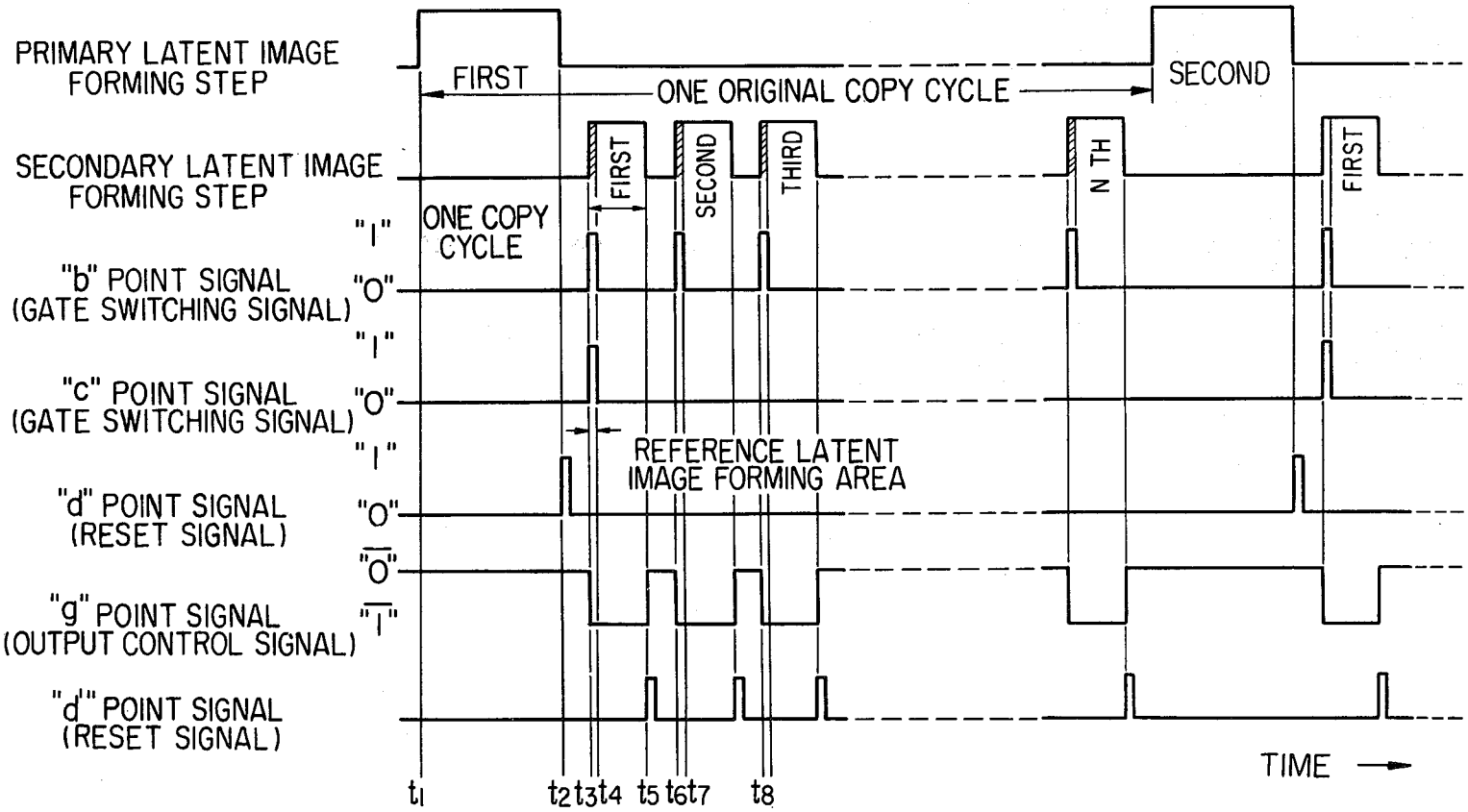
FIG. 14 is a timing chart for the image forming process.

In the following, operations of the whole circuit will be explained in reference to FIG. 14 which shows the timing chart of signals emerging at the primary electrostatic latent image forming step, the secondary electrostatic latent image forming step, and respective points b, c, d, d', and g.

As soon as the first primary electrostatic latent image forming step ($t_1$–$t_3$) in the entire reproduction steps is terminated, a signal of a logic "1" is applied to the point d with a timing of $t_2$ to thereby reset old data held in the capacitors 5A-2 and 6A-2 in the sample and hold circuit. Next, the first secondary electrostatic latent image forming step starts with a timing of $t_3$, at which an output value from the high voltage power source 13A for the secondary electrostatic latent image formation produces a reference value. The reason for this is that, since the capacitors 5A-3 and 6A-3 in the sample and hold circuit 5A are both reset, the outputs therefrom are at the same level, and an output (point f) from the error detection circuit 7A is zero. Accordingly, an output from the high voltage output correcting circuit 9A becomes a reference value to be determined by the high voltage reference value generating circuit 8A. In this condition, when a signal "$\overline{1}$" enters into the point g, the high voltage power source is turned on, and the high voltage output produces the reference value. In this state, a voltage emerging at a terminal Ⓐ of the detecting element 38 for corona current passing through the screen with a timing of between $t_3$ and $t_4$ corresponds to corona current due to a reference electrostatic latent image formed at the tip end part of the image, etc.. Also, since the change-over signals at the points b and c of the gate are given an input logic signal "1", the capacitors 5A-2 and 6A-2 in the sample and hold circuits 5A and 6A accumulate therein data corresponding to the first reference secondary electrostatic latent image. In this state, an output from the error detecting circuit still remains zero. The output does not change after a gate change-over signal is changed over to "0" with a timing of $t_4$ until the second secondary electrostatic latent image forming step begins, when a logic signal "1" is again input into the point b for the gate change-over signal with a timing of $t_6$ and new data are held in the sample and hold circuit 5A. Also, the high voltage power source 13A is turned off, since a signal at the point g is changed over to "$\overline{0}$" with the timing of $t_5$. Consequently, during the first secondary electrostatic latent image forming step ($t_3$–$t_5$), the high voltage power source 13A produces an output at the reference value.

Next, in the second secondary electrostatic latent image forming step ($t_6$–$t_8$), when the corona current for the reference electrostatic latent image formation is measured, and a signal "1" is input in only the point b for the gate change-over signal with a timing of $t_6$–$t_7$ to sample and hold the data, only the sample and hold circuit 5A holds therein the new data, while the sample and hold circuit 6A continues to hold therein the initial data. In this state, if the data held in the sample and hold circuit 5A differ from the initial data in the previous time, the difference appears at the point f as an output from the error detection circuit. The value at the point f is input into a subsequent high voltage output correction circuit 9A to be added to, or subtracted from, the output from the high voltage reference value generating circuit 8A to thereby determine the high voltage output value. Here, when the output from the error detection circuit 7A takes a positive value, i.e., when current to be measured is reduced from the initial value, correction is made in such a manner that the high voltage output may be increased. Conversely, when the output takes a negative value, i.e., when the corona ion current exceeds the initial value, correction is made in such a manner that the high voltage output may be reduced. In the above-described manner, the high voltage output is corrected so that the corona current may be equal to the initial value, with the output of which the secondary electrostatic latent image forming step is effected with a timing of from $t_7$ to $t_8$. Thereafter, when the secondary electrostatic latent image forming step is to be carried out for n numbers of times, the same operations as mentioned above are repeated, and control is effected to constantly obtain an image equal in quality to that of the initial image. During the abovementioned operations, if the voltage value of the high voltage output or its current value exceeds its reference value, an output of B is cut or limited within its safe range by the function of the voltage-current limiting circuit 11A.

Figure 19:
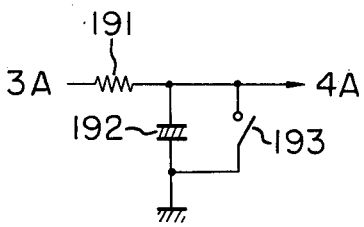
FIGS. 19 and 20 are, respectively, wiring diagrams for other embodiments of the circuit shown in FIG. 11.
Figure 20:
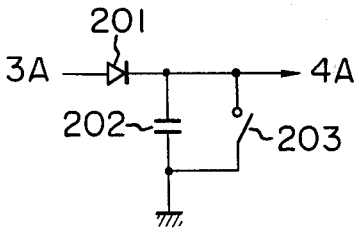

In the above-described embodiment, a corona ion current for forming the reference secondary electrostatic latent image formed at the tip end part of the image, etc. is used as the data. However, if it is intended that an integrated value of the corona current to be used for forming the secondary electrostatic latent image which contributes to the first image transfer operation is used as the data, this can be realized easily by inserting a general type resettable integration circuit between the d.c. amplifying circuit 3A and the analog gate circuit 4A in the circuit shown in FIG. 11 to properly change the timing of the gate change-over signal. FIG. 19 shows such a circuit construction, wherein a numeral 192 refers to a capacitor having a large capacity, which forms the integration circuit along with a resistor 191. In this case, it is advisable that a signal b be set for output before start of the secondary latent image formation at an even numbers of times, and that a signal c be set for output before start of the second secondary latent image formation alone. A contact 193 closes momentarily right after stoppage of output of the signal b, i.e., the secondary latent image at an odd number of times is compared with the initial latent image. In case the maximum value of the corona current to be used for the first secondary electrostatic latent image formation is used as the data, a general type of resettable peak value detection circuit is inserted between the d.c. amplifying circuit 3A and the analog gate circuit 4A in the circuit shown in FIG. 10 to adequately change the timing of the gate change-over signal, thereby readily attaining the control. FIG. 20 is one example of such circuit, wherein a reference numeral 202 designates a capacitor having a small capacity, which forms a peak detection circuit together with a diode 201. In this case, too, the signals b and c and a contact 203 may be in the same timing as in the case of the circuit shown in FIG. 19. These two cases may be applicable to an object to be detected, wherein the surface potential of the primary or secondary latent image is directly detected by a potential probe.

Figure 23:
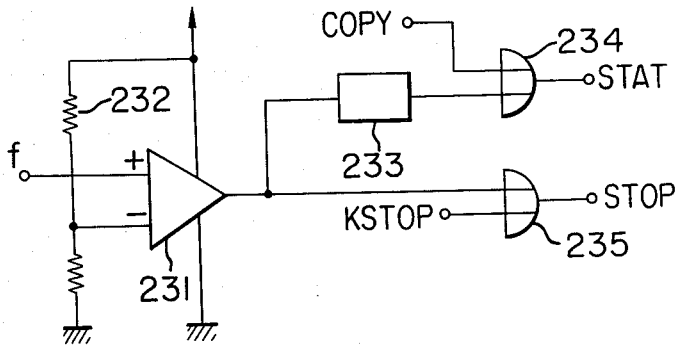
FIG. 23 is a wiring diagram showing one embodiment of the circuit for automatic change in the electrostatic latent image formation.

Further, it can be readily understood that, in case the output from the high voltage power source for the secondary electrostatic latent image formation is fixed, the limitation to the number of retention copying times is set at a point when the secondary electrostatic latent image has lowered from its initial state by a certain ratio, and re-formation of the primary electrostatic latent image is effected automatically at that point, the output from the high voltage output unit 13A in the circuit of FIG. 11 is fixed, and a certain definite voltage is introduced as an input into a reference input unit of a circuit to determine the output from the error detection circuit 7A (a general comparator with the point f as one of its input), as shown in FIG. 23.

Also, when both output voltage and current of the high voltage output circuit exceed their respective limit values, it is readily practicable that a warning signal be generated by an output from the voltage-current limiting circuit 11A in FIG. 11, or copying operation be stopped, or else.

The above-described embodimental circuits are to directly detect, by electric current in the screen due to the corona ion current through the screen, changes in the forming state of the secondary electrostatic latent image due to changes in the screen after time lapse, and changes in the secondary electrostatic latent image accompanied by the modulation. According to these embodiments, it is possible to constantly obtain uniform reproduction copy in correspondence to the forming condition of the secondary electrostatic latent image due to changes in the screen condition with time lapse. It is also possible to obtain constantly uniform reproduction copy throughout the retention copying operations.

For another example of the method for changing the output at the side of the high voltage power source, there is such one that the abovementioned output is applied to the developing means, and the bias voltage of the developing electrode of the developing means is changed, while the forming conditions of the primary or secondary electrostatic latent image remains unchanged, thereby effecting the constantly uniform reproduction operations. The term "developing electrode" is meant by a tray for adhering the powder toner or developing liquid to the latent image. In the case of a sleeve developing system, it is possible to control the bias voltage applied to the sleeve in the abovementioned manner.

Also, by regulating the number of retention copying in accordance with the screen conditions, as in the above-described examples, the retention copying can be carried out to the maximum possible extent. Further, since the detection and control are effected with such sample and hold technique, not only a simple change in the secondary electrostatic latent image, but also changes in the screen condition per se with time lapse can be detected, unlike a case, wherein a predetermined value is established to merely compare this set value with the potential of the secondary electrostatic latent images thus formed for the image formation. Such technique enables a very fine and delicate adjustment to be effected in the electrostatic latent image formation. Incidentally, in the case of FIGS. 19 and 20, when the image developing and transferring are to be carried out after completion of the secondary electrostatic latent image formation, such secondary latent image is detected every time to control the development and image transfer, whereby the visible image can be stabilized at every time. It goes without saying that the present invention is also applicable to a case, wherein a difference resulted from comparison of a preset reference voltage and a detected potential is held so that it may contribute to the control operation as mentioned in the foregoing.

Figure 15:
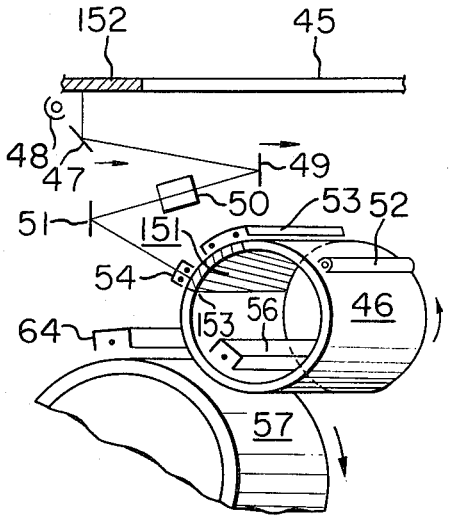
FIG. 15 is a perspective view of a screen drum unit.

Here, the reference latent image may be formed on a part 151 of the screen 46, as shown in FIG. 15. This latent image can be formed by first exposing a field 152 of a uniform density provided at one end of a platen 45 with a lamp 48 followed by a subsequent image exposure. FIG. 15 indicates a state when the primary electrostatic latent image is to be formed. The gate change-over signal b can be generated at the time of the primary electrostatic latent image formation by a cam (to be provided on a screen drum) to turn on and off the switch in a time instant, during which a detected signal can be held, when the part 151 reaches a charger 56 and passes therethrough. As another example, where the apparatus is provided with a generator which responds to a screen motor generating a series of pulses by rotation of the screen, and a counter to count the generated pulses, the gate change-over signal b can be generated by a counted value of the pulses by commencing the pulse counting at every time the front end 153 of the screen passes through the screen stoppage position (i.e., at the position of the lamp 52).

The signal c is a selection from the abovementioned signal b in its first emission. The reset signal d can be generated by a cam (provided on the screen drum) to turns on the switch when the screen completes one rotation and arrives at a position shown in FIG. 15. As still other example, there may be used a signal indicating that the primary electrostatic latent image is being formed such as an operation instruction signal, etc. for the charger 53, or a signal indicating termination of the retention copying such as that showing the signal g at the nth time being zero, and others.

Figure 16:
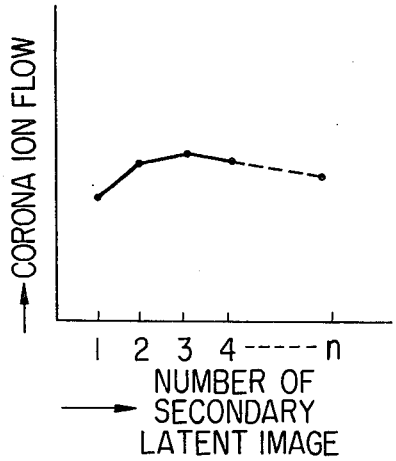
FIG. 16 is a graphical representation showing the characteristic of corona ion.
Figure 18:
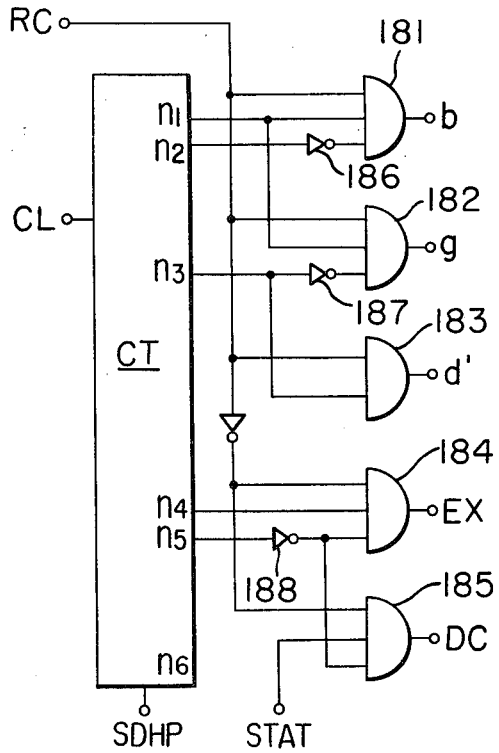
FIG. 18 is a wiring diagram for an embodiment of a timing control circuit shown in FIG. 1.
Figure 17:
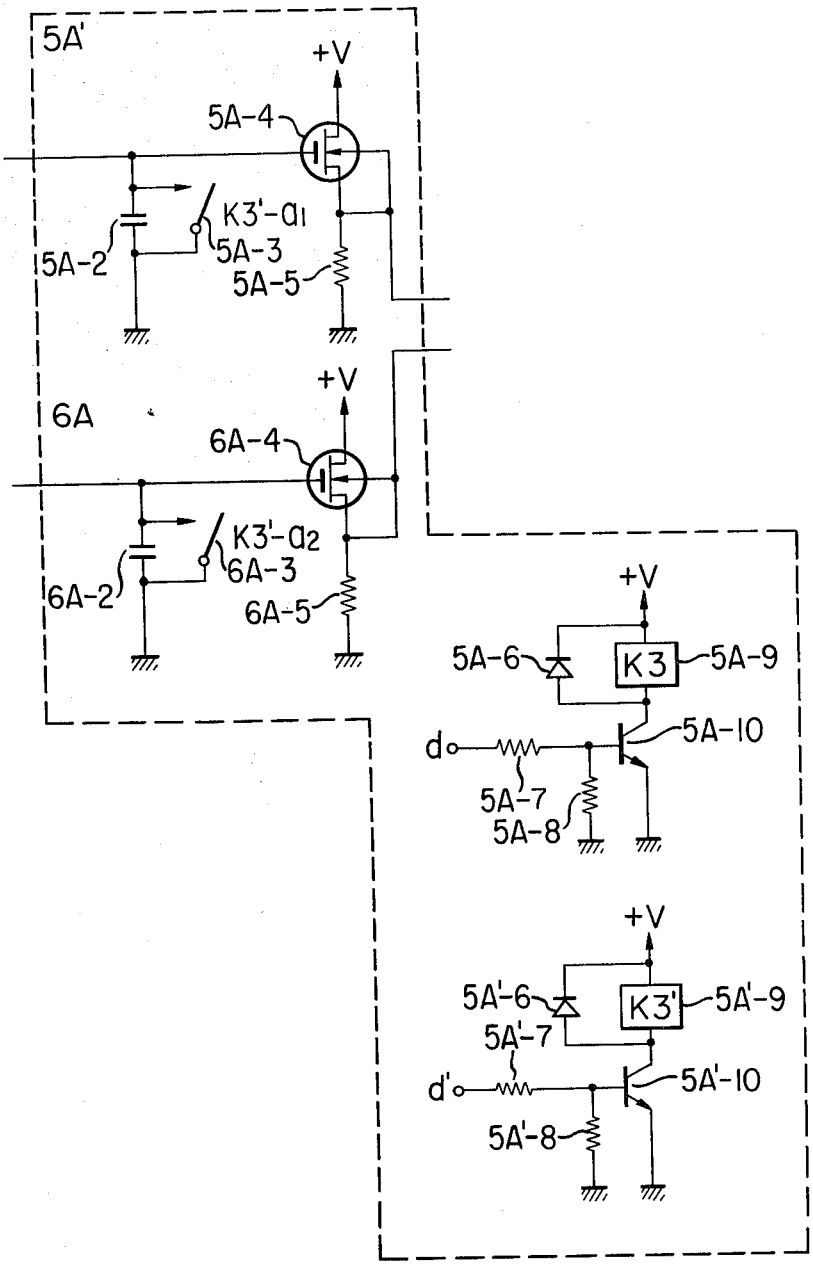
FIG. 17 is a wiring diagram for another embodiment of the error detection circuit shown in FIG. 12.

FIG. 18 shows one example of more effective automatic control of the corona ion current, wherein changes in the quantity of the ion current is of such a property as shown in FIG. 16, i.e., it first rises up, and, after that, it lowers with respect to the number of retention copying time. In other words, in place of the sample and hold circuit 5A in FIG. 12, a circuit 5A' shown in FIG. 17 is substituted, and, if the reset signal d' is made as shown in FIG. 14, the hold value in the hold element 5A-2 can be corrected at every termination of the secondary electrostatic latent image formation. This reset signal d' can be generated by detecting rising of the control signal g. For another method, the reset signal d' can be generated with a predetermined count number n3 by counting the abovementioned pulse.

In the embodiment shown in FIG. 18, RC denotes a signal "1" when the primary latent image is not formed, CL designates the abovementioned pulse, CT refers to a counter, numerals 181 to 185 designate "and" gates, numerals 186 to 190 refer to inverters, EX designates a signal for controlling timing of a lamp, 48 and a charger 54, DC denotes a signal for controlling timing of a lamp 52 and a charger 53, SDHP designates a drum stoppage position detection signal to reset the counter CT (by a drum cam and switch), and START denotes a copy start signal (to cause the screen drum to start its rotation from its stoppage position). When the pre-exposure lamp 52 and the primary DC charger 53 are turned on in synchronism with start of the screen drum for its rotation, and the pulse number assumes M4, i.e., the front end of the screen arrives at the exposure position, the image exposure lamp 48 and the AC charger 54 are turned on simultaneously, and, at the same time, the optical system is forwarded to commence the primary electrostatic latent image formation. Thereafter, when the pulse number reaches n5, they are all turned off to cause the optical system to return, thereafter, when the pulse number reaches n6, the RC is rendered "1" which will be held until the retention operation is terminated. As soon as the tip end of the screen reaches the stoppage position, the counter CT is reset to count the pulse again to produce, as outputs, the gate change-over signal b and the high voltage signal g at the time of n1, thereby forming the secondary electrostatic latent image. In this case, the output signal b is produced at the point n1, while the output signal g is produced at a point between n and n3. Thus, by repeating the above-described operations, there can be obtained the retention copies to the maximum possible number.

In the following, restarting of the primary electrostatic latent image formation will be explained in reference to FIG. 23. A comparator 231 discriminates whether the signal f is above its limit or not. If it exceeds the limit, a STOP signal output is produced through an "or" gate 235 to thereby cease operations of the image transfer sheet supply and the modulating corona charger. A reference letters "KSTOP" designates an operating signal to stop the reproduction apparatus manually. Thereafter, upon lapse of a certain time interval by a timer 233, the STAT signal output is produced through an "or" gate 234, whereby the primary charger, AC charger, optical system, lamp, and so on commence their operations with the timings as mentioned in the foregoing to thereby form the primary electrostatic latent image. A reference letter "COPY" designates an operating signal to start the reproduction apparatus manually.

Figure 21:
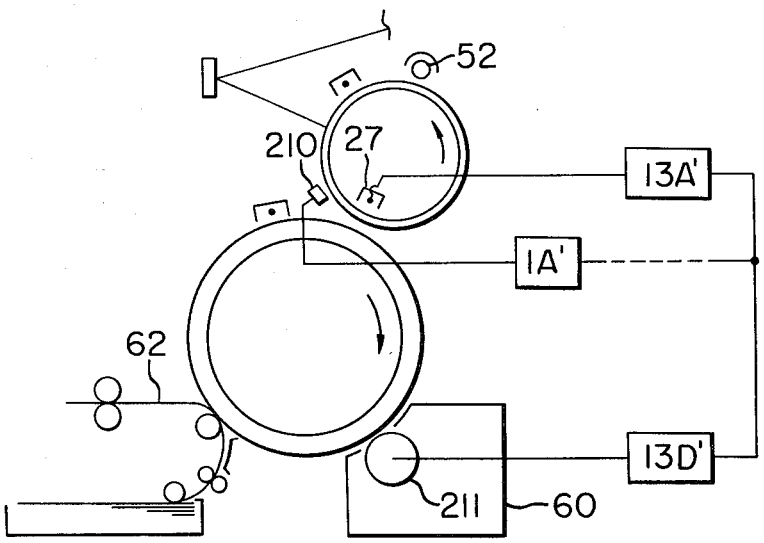
FIGS. 21 and 22 are, respectively, schematic diagrams showing other embodiments of the control circuit.

FIG. 21 shows one embodiment of the reproduction apparatus to obtain a satisfactory developed image, in which the potential of the electrostatic latent image on the screen is directly detected by a surface potential probe 210 to control a bias voltage on a modulating charger 27 and/or a developing roller 211. In the drawing, reference numerals 1A' to 7A' denote the same circuits 1A to 7A as mentioned above, in which the reference values are made different. 13A' is made correspondent to the change-over timing of the circuit 13A when the part 151 passes through the position of the probe 210, and 13D' differs from the circuit 13A in its output voltage value.

Figure 22:
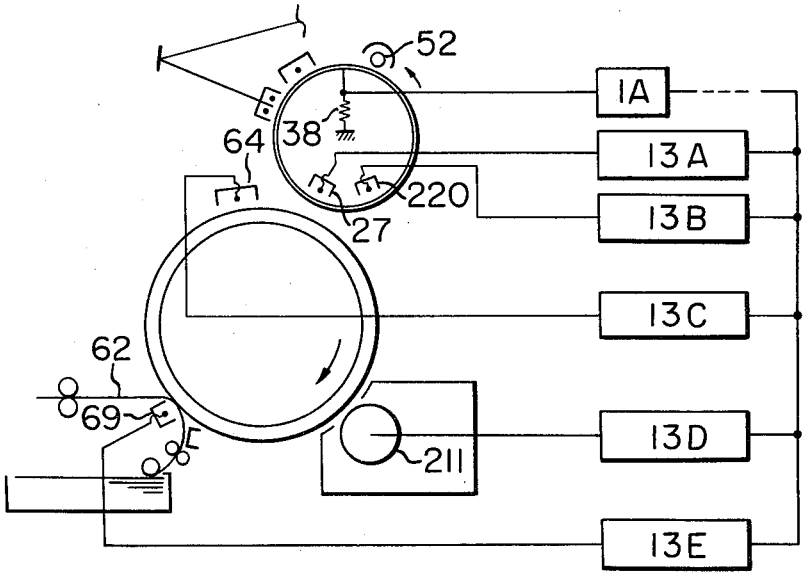

FIG. 22 shows one embodiment of obtaining a satisfactory ultimate transfer image by controlling at least one of a voltage of a modulating charger 27, a voltage of a charger 220 for correcting the primary electrostatic latent image, a voltage of a charger 64 for imparting a potential to an insulating body 59, a bias voltage of a developing roller 211, and a voltage of an image transfer charger 69, through an ion current detecting resistor 38. That is to say, any deterioration to occur possibly at the time of the secondary electrostatic latent image formation, image developing, and image transferring can be corrected. Incidentally, the apparatus in FIG. 21 utilizes a selenium type photosensitive screen as the primary member.

In the following explanations will be given as to control of the toner feeding in accordance with the electrostatic latent image formed.

Figure 24:
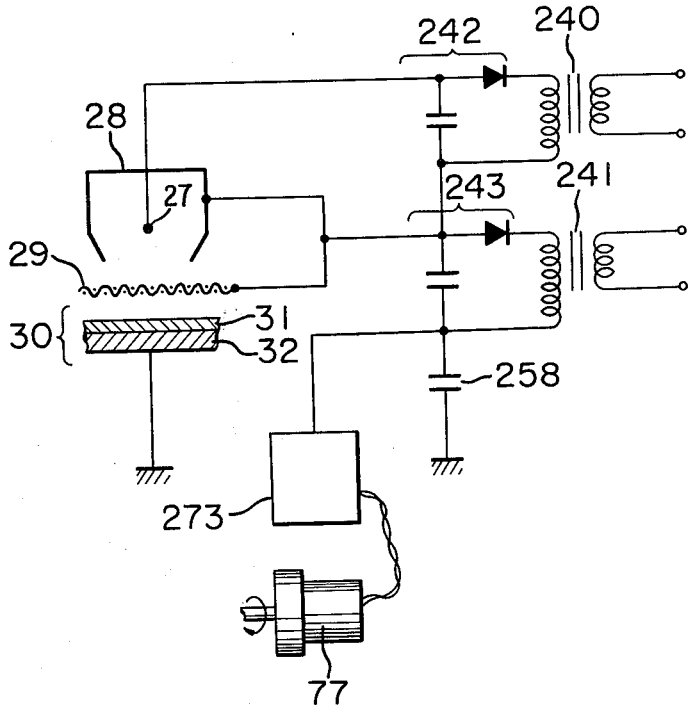
FIG. 24 is a schematic diagram for explaining a toner feeding device to the developing means in FIG. 1.

FIG. 24 shows one embodiment of the circuit construction, in which a reference numeral 258 designates a capacitor for ion current detection, from which a mean value of positive and negative current can be obtained. Numerals 240 and 241 respectively designate a transformer to apply a voltage to a wire 27 and a transformer to apply a bias voltage to a screen 29. Numerals 242 and 243 respectively designate a diode to rectify the outputs from each of the transformers and a capacitor. The electric charge quantity due to the corona ion current in the negative polarity passing through the screen 29 can be detected by measuring the potential of the capacitor 258. The charge quantity is converted at a control circuit unit 273 to an output for rotating a motor 77.

Figure 25:
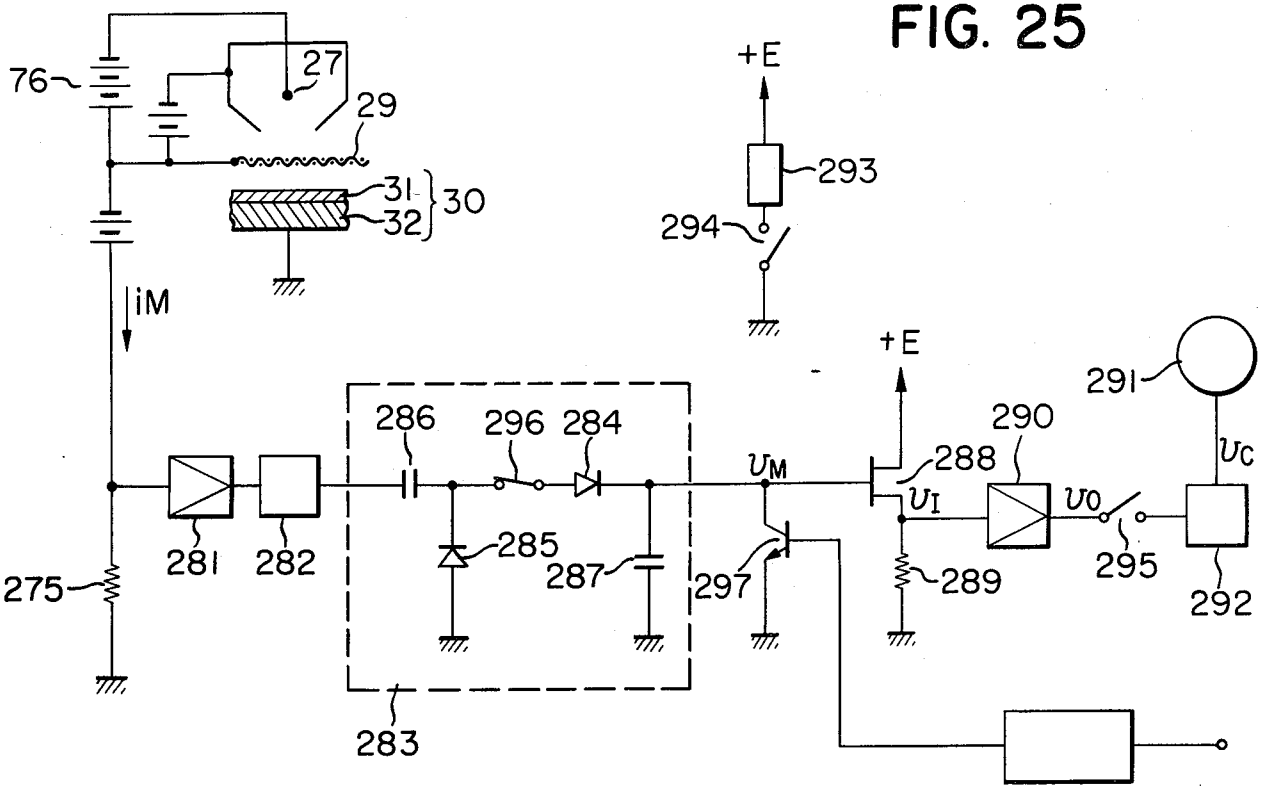
FIG. 25 is also a schematic diagram showing another embodiment of the present invention.

Another example of the toner feeding according to the present invention, besides that as above mentioned, will be as follows. FIG. 25 illustrates a circuit construction of a case, wherein a bias voltage is applied to the screen 27 and the recording medium side is grounded. An element 275 to detect the charge quantity due to the corona ion current passing through the screen is provided between a screen bias power source 76 and the earth. In the drawing, electric current flowing through the charge quantity detecting element 275 becomes modulated by the primary electrostatic latent image formed on the screen 294. In other words, the illustrated embodiment is in such a case that a negative high voltage (or positive high voltage) is applied to the modulating corona discharger 77, wherein an area charged in the positive polarity and an area charged in the negative polarity are arbitrarily coexistent on the screen 29 in the form of an electrostatic latent image. For example, in the positively charged area on the screen 29, the negative corona ion to be generated from the abovementioned discharger 27 passes through a gap or clearance in the screen 29 and is attracted to the recording medium 78. On the other hand, in the negatively charged area on the screen 29, the negative corona ion generated from the discharger 27 is absorbed into the screen, and cannot reach the insulating layer 31 of the recording member 30. Accordingly, there is formed an image due to the negative charge on the insulating layer 31 of the electrically conductive substrate 32 at a position beneath the screen corresponding to the positively charged area thereon.

On the other hand, the positively charged toner in the developing agent adheres onto the negatively charged area on the abovementioned insulated drum by the magnetic brush developing method as in the above-described embodiment. This adhered toner will thereafter be transferred onto the image transfer material and image-fixed under heat to become a complete reproduction copy. Accordingly, the electric current IM following through the charge quantity detecting element 275 is a current corresponding to the charge quantity modulated by the primary electrostatic latent image formed on the screen. The above-described embodiment makes it possible to detect the toner consumption in the developing means by integrating the current IM per unit time and to feed the toner in a quantity corresponding to that consumed, thereby providing a more stable picture image. Further, in the reproduction apparatus equipped with a retention copying mechanism as in the device shown in FIG. 1, a total consumption of the toner for predetermined numbers of sheet of reproduction copy can be estimated by measuring the current IM of the first sheet, from which the toner feeding quantity can be determined. Furthermore, when the retention copying capability becomes lowered, the current IM is measured intermittently to correct the toner feeding quantity per sheet. Such functions will hereinafter be described in more detail.

The current IM obtained by the modulation flows through the detecting element 275, whereby a voltage for its lowered portion can be obtained. Since the abovementioned current IM is in a small value, it is amplified by an amplifier 281 and then converted into a direct current pulse by a rectifying circuit 282, after which it is accumulated in an accumulating circuit 283 in a cascade form. A positive pulse signal as rectified in the rectifying circuit 282 makes a diode 284 conductive. However, since a diode 285 is reversely biased and intercepted, capacitors 286 and 287 are charged through the abovementioned diode 284. On the other hand, the capacitor 286 becomes discharged when the positive pulse signal returns to a zero potential, and the pulse signal is accumulated in the capacitor 287 in a cascade form. The thus accumulated charge is introduced into the gate of a field effect transistor 288, as an input. The reason for utilizing the field effect transistor (hereinafter abbreviated as "FET") is that, for preventing the charge accumulated in the capacitor 287 from being unexpectedly discharged, there should be used a transistor having a very high input impedance. To the source of the FET, there is connected a resistor 289 for taking out the above-mentioned charge. A resistor 289 for taking out the above-mentioned charge is connected to the source of FET. The voltage breakdown caused in this resistor 289 is substantially equal to the charge accumulated in the capacitor 287, which is amplified by a d.c. amplifier 290 and introduced into a speed control circuit 292 of a motor 291 for the toner feeding. The abovementioned speed control circuit 292 produces an output voltage proportional to an input voltage, by the changes of which the speed of the d.c. motor is varied. Incidentally, a toner feeding screw is connected to the d.c. motor 291 as in the device 43 shown in FIG. 1. Accordingly, in case the accumulated charge in the capacitor 287 is small, the speed of the d.c. motor 291 is slow, hence the toner feeding quantity is small. On the contrary, when the accumulated charge is large, the speed of the d.c. motor is fast, hence the toner feeding quantity becomes increased. In other words, when the toner consumption is large, the current IM becomes accordingly large, so that the charge accumulation, hence the toner feeding quantity becomes increased. The relay 293 is controlled for its on and off operations by the abovementioned control switch 294 so that the toner may be supplied for only a specified time period. Further, when the relay 293 is actuated to close the contact 295, and the speed of the d.c. motor 291 begins to be controlled with a voltage proportional to the charge quantity accumulated in the capacitor 287, a contact 296 associated with the relay 293 is turned off to thereby stop accumulation of the current IM in the capacitor 287. When the toner feeding time is terminated, the relay 293 immediately forwards a signal to the base 298 of the transistor 297 to turn it on, thereby discharging the charge accumulated in the capacitor 287. In a reproduction apparatus having the retention copying mechanism, an electrostatic latent image which has once been formed on the screen 29 is used for modulation over multiple numbers of times. Therefore, the toner consumption per copy sheet can be estimated by previously measuring the current IM in the first modulation through the circuit construction shown in FIG. 25, hence there is no necessity for measuring the current IM at every modulation. In this case, if the discharging time of the capacitor is long, the number of the capacitor to be provided can be only one. An appropriate control timing can be obtained by, for example, closing the contact 296 during formation of the first secondary latent image, and opening the same continuously after the second formation thenceforward, or by closing the contact 295 for a certain specified time period after termination of each secondary latent image formation, or by turning on the transistor 297 before commencement of the first secondary latent image formation. Furthermore, when the retention copying capability is lowered as the result of multiple modulating operations with one and same electrostatic latent image, and thereby changes occur in the image, the current IM is further measured intermittently so as to correct the toner feeding quantity. In this case, an appropriate control timing can be obtained by interlocking the contacts 295 and 296 in such a manner that they may be opened or closed when the secondary latent image formation is terminated, and that they may be opened or closed when the latent image formation is re-started.

Figure 26:
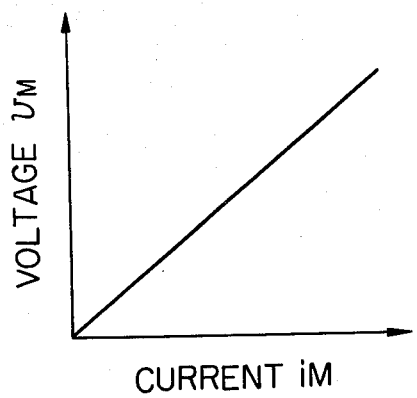
FIG. 26 is a graphical representation showing a relationship between electric current IM caused by a quantity of modulated ion and direct current voltage VM accumulated in a capacitor 87 after rectification of the current IM.
Figure 27:
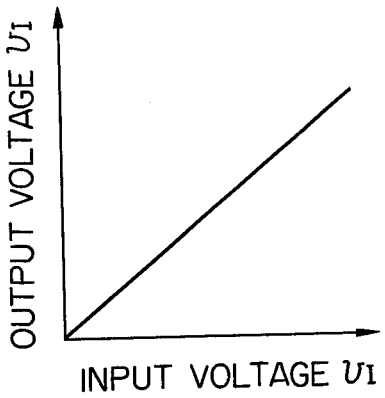
FIG. 27 is a graphical representation showing input and output characteristics of a direct current amplifier 90.
Figure 28:
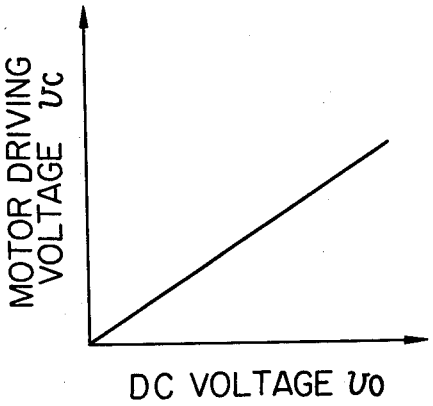
FIG. 28 is also a graphical representation showing a characteristic of a speed control circuit 92.
Figure 29:
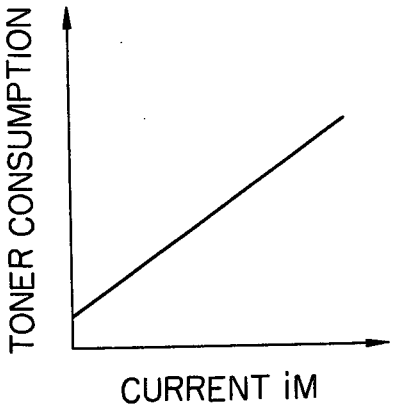
FIG. 29 is a further graphical representation showing a relationship between the current IM and a quantity of toner which the image transfer material takes out.

Next, graphical representations in FIGS. 26 to 28 show the characteristics of each unit in FIG. 25. FIG. 26 is the graphical representation showing a relationship between the current IM corresponding to the modulating ion quantity and a d.c. voltage VM accumulated in the capacitor 287 after the current IM has been rectified. This graph shows that when the value of the current IM is large, the accumulated d.c. voltage VM is also large. FIG. 27 is the graphical representation showing the input and output characteristics of the d.c. amplifier 290, in which the input voltage of the d.c. amplifier 90 takes a substantially identical value with that of the above-mentioned voltage VM. The graph shows that, since the amplifier is well known and well used ordinarily, its characteristic is such that a voltage proportional to the input voltage is produced as an output. The reason for amplifying the voltage by the d.c. amplifier 290 is that a level of the output voltage to the resistor 289 connected to the source terminal of the FET 288 is relatively small in its value. FIG. 28 indicates the characteristic of the speed control circuit 292. That is, the speed control circuit is for driving the d.c. motor 291, and the characteristic of the d.c. motor is such that its number of revolution is proportional to the voltage to be applied. Accordingly, the speed control circuit 292 is to control a d.c. voltage (a voltage to be applied to the motor) proportional to an amplified d.c. voltage Vo, hence a voltage proportional to the input voltage is naturally produced as an output. FIG. 29 is the graphical representation showing a relationship between the current IM and a toner quantity which the image transfer material uses. From this graphical representation, it is understood that the larger the current IM is, the larger becomes the toner consumption by the image transfer material.

Figures 30, 31:
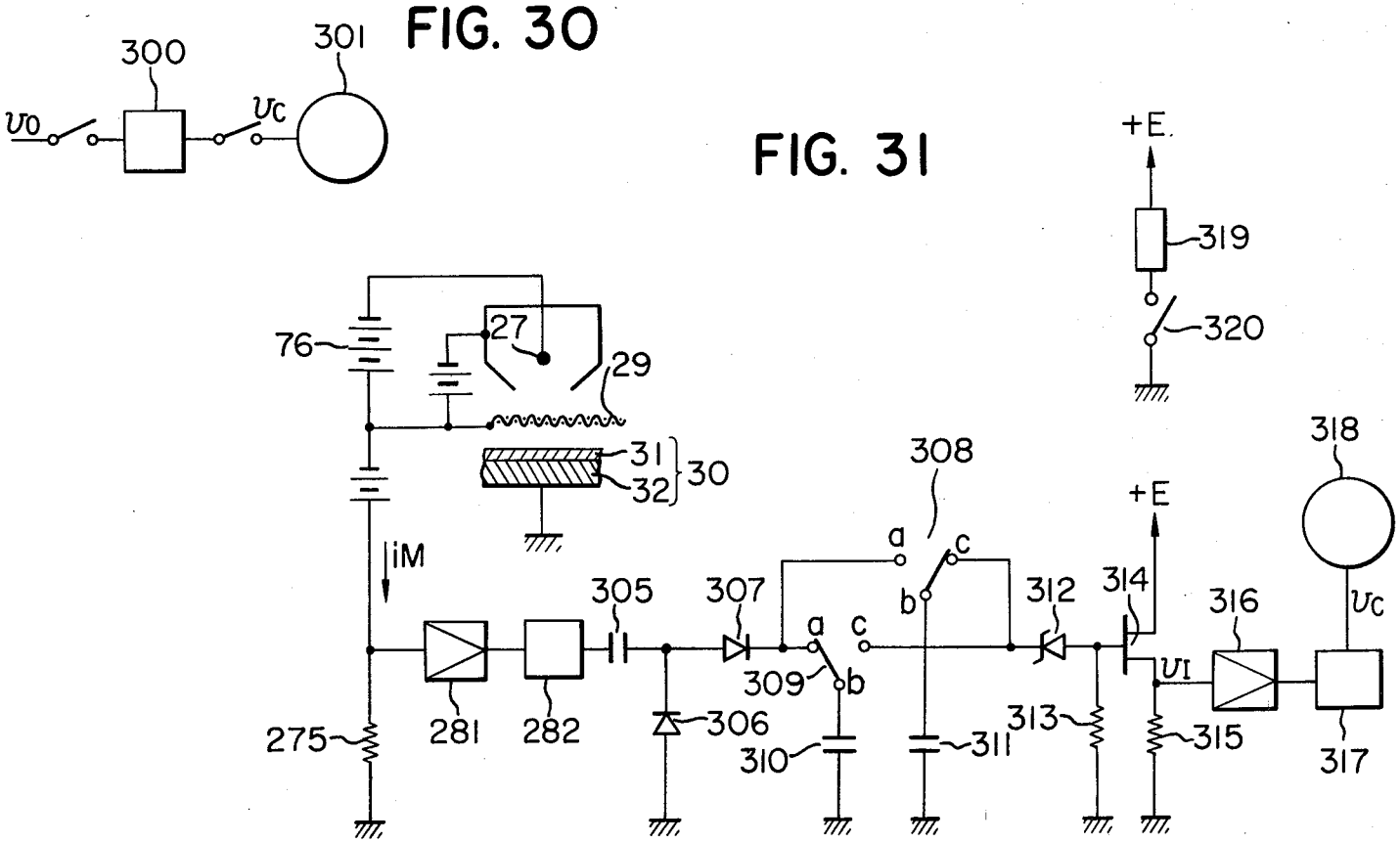
FIGS. 30 and 31 are, respectively, schematic diagrams showing other embodiments of the present invention.

FIG. 30 shows an embodiment, in which a pulse motor is employed as a driving power source for the toner feeding means. In this circuit diagram, since a circuit to produce an output voltage Vo is identical with that shown in FIG. 25, any detailed explanations thereof will be dispensed with. A signal amplified by the d.c. amplifier 290 is converted into a pulse signal by means of an A-D converter 300, and a pulse motor 301 is driven by this pulse signal. That is to say, depending on magnitude of the accumulated charge quantity, a pulse cycle or a pulse width is varied by the A-D converter 300, thereby enabling the speed of the pulse motor 301 to be controlled. It is also possible to have such a construction, wherein at an instant when the output from the abovementioned d.c. amplifier 290 takes a definite value, the driving time or driving quantity of the pulse motor 301 is rendered constant, and the charge in the charge accumulating capacitor is discharged simultaneously.

FIG. 31 shows a developer feeding system, the characteristic paint of which resides in that as a method for accumulating electric current quantity caused by the modulating ion current passing through the screen, the current is accumulated alternately in the first and second accumulating means, and the toner feeding means is operated with an output from either accumulating means, and, at the same time, the accumulating means is changed over. More detailed explanation will be given along with FIG. 25. A point of difference from FIG. 25 is that two units of the accumulating means for the modulated ion current quantity I are provided. That is to say, in FIG. 31, the current IM is amplified by the amplifier 281 and rectified by the rectifying circuit 282. When a positive pulse is generated, it causes the diode 307 conductive through the capacitor 305 to thereby charge the capacitor 310, although contacts 308 and 309 of the relay 319 are in contact with the respective sides c and a. If the current IM becomes zero, the charge accumulated in the capacitor 305 is discharged through the diode 306, although the charge accumulated in the capacitor 310 is not discharged. On the other hand, when a certain sampling time is terminated, the contact 320 is closed, and the relay 319 is turned on, whereby the contacts 308 and 309 are changed over. If the charge voltages of the capacitor 310 is higher than a zener voltage of a Zener diode 312, the diode 312 becomes conductive and the charge accumulated in the capacitor 310 is discharged through the resistor 313 to continue its discharge until the charge voltage lowers down to the level of the zener voltage. As the result, an output voltage is produced across both ends of the resistor 315 during the continued discharge, and this output voltage is amplified by the amplifier 316 to drive the d.c. motor 318 through the motor drive circuit 317, whereby the toner is supplied. If the voltage accumulated in the capacitor 310 is lower than the zener voltage, the motor does not rotate. That is, the toner feeding time is controlled in accordance with the charge quantity in the capacitor 310. When the capacitor 310 is in contact with the side c of the contact 309, it is naturally contacted with the side a of the contact 308, so that charging is done in the capacitor 310. Subsequently, when the sampling time is arrived, the contact 308 is opened to turn off the relay 319, and the contacts 308 and 309 are changed over, thereby repeating the same operations as mentioned above. Accordingly, by changing over the contact 320 at a certain sampling time, it becomes possible to continuously measure the current IM and to control rotation of the motor 318 for the toner feeding in accordance with the measured value of the current IM. It should be noted that, although a discharge resistor 313 is provided in the circuit construction shown in FIG. 31, there can also be used the discharge transistor 197 shown in FIG. 25 in place of such discharge resistor 313. For the method of controlling the motor rotation, there may be used the A-D converter and the pulse motor. As stated in the foregoing, since the device shown in FIG. 31 continuously sample the electric current, stable toner supply becomes possible. Incidentally, when the on-off operations of the switch 320 are performed at every commencement of the secondary electrostatic latent image formation, there can be obtained an appropriate sampling timing.

Further effect to be derived from the present invention is that the state of the secondary electrostatic latent image formation can be made known by providing the abovementioned detecting means at the position in the circuit shown in the drawing, without handling a high tension current. Also, since it is not necessary to provide any special latent image forming area for detecting the latent image, the space within the apparatus can be utilized effectively. More important is that the method according to the present invention makes it possible to readily detect a quantity of the corona ion current passing through the entire surface of the screen, as the result of which there accrues such other efffect that not only the changes in the latent image potential at one portion of the area on the screen, but also an average change in the primary electrostatic latent image on the entire surface of the screen can be detected.

Moreover, according to the present invention, since the toner is supplied in accordance with the change quantity passing through the screen, i.e., in accordance with a quantity of the secondary electrostatic latent image, an equal quantity of toner to that consumed by development of the abovementioned secondary electrostatic latent image can be supplied. On account of this, the toner concentration of the developer in the developing means can be maintained constant, which results in obtaining a satisfactory image over a long period of time. In addition, the control for the toner feeding is extremely accurate and no excessive amount of toner is supplied, hence the apparatus can be maintained economically. In view of the fact that, in the present invention, the charge quantity due to the ion current passing through the screen is detected, even when the screen becomes deteriorated due to extended use, or the quantity of the modulated ion current changes during the retention copying, the toner feeding quantity can be controlled in conformity to such changes. This point constitutes a difference from the conventional method, in which the toner feeding quantity is preset. Also, in the present method, the detected signal can be used not only for the toner feeding, but also for controlling the image forming conditions. As one example of such methods of use, there is such a method that the image change during the retention copying is prevented. In more detail, the secondary electrostatic latent image at the time of the initial modulation is stored in a memory element, after which, when the secondary electrostatic latent image changes with increase in the number of modulating times, the image forming conditions may be controlled in such a manner that it assume the same state, as in the initial stage. Needless to say, this method is also effective to the primary electrostatic latent image forming conditions.

Although, in the foregoing explanations of the present invention, only the toner feeding operations in the developer have been described, the method is also applicable to supply of carrier particles. In other words, in case the carrier is lost in proportion to the toner quantity to be supplied for the development, such carrier may be fed simultaneously with the toner.

The developer is not limited to the dry type developer as used in the foregoing embodiments. When liquid developer is used, a concentrated developing liquid can be fed in accordance with a detected signal. More concretely, a feeding port of a vessel containing therein such concentrated developer is actuated by a driving means such as a plunger, etc. to feed an appropriate quantity to the side of the developing means, as has been done heretofore.

Furthermore, the charge quantity to be detected by the ion current passing through the screen is meant by that can be detected in the form of current or voltage, while the ion current includes particulate substances such as charged toner, ink, etc. In the image forming apparatus which directly modulates the particulate substances, such substances may be supplied to the side of the generating means for the particulate substance on the basis of the abovementioned principle. The screen to be used in the present invention is not limited to the foregoing embodiments, but there can be used various types of the modulating elements such as a screen having a pre-perforated pattern, aperture board, and so forth. For the member for forming the secondary electrostatic latent image, there can be used either an insulated drum which is used repeatedly, or an insulative sheet. For the image forming apparatus, there are various types such as reproduction apparatus, recording apparatus, and printing apparatus.

In embodying the present invention in the system wherein plural copies are taken from one original, it is possible to control the toner supply and/or the voltage of a charger in accordance with the above described sampling method in response to a signal corresponding to an original capacity, that is, the contrast of the original detected optically, thereby to provide optimum contrast of the copies.

What we claim is:

1. An image forming apparatus comprising:

(a) first and second electrically chargeable members;

(b) first processing means to form a primary electrostatic latent image on said first chargeable member;

(c) second processing means to form a secondary electrostatic latent image on said second chargeable member based on said primary electrostatic latent image, to develop said secondary electrostatic latent image, and to transfer the thus developed image onto an image transfer material;

(d) means for detecting a visible image forming capability of one of the electrostatic latent images; and (e) means for controlling in response to an output from said detecting means, at least one of said first processing means and said second processing means so as to form a developed image of a predetermined image density.

2. The image forming apparatus as claimed in claim 1, wherein said second processing means is provided with means for generating ion current in accordance with a potential of said primary electrostatic latent image, and said detecting means detects the ion current.

3. The image forming apparatus as claimed in claim 1, wherein said second processing means is provided with means for regulating adherence of toner to said secondary electrostatic latent image, and said control means controls said regulating means.

4. The image forming apparatus as claimed in claim 1, wherein said second processing means is provided with means for generating ion current to said second chargeable member in accordance with a potential of said primary electrostatic latent image, and said control means controls said ion current generating means.

5. An apparatus according to claim 1, wherein said detecting means detects a surface potential of said first chargeable member.

6. An apparatus according to claim 1, wherein said second processing means includes means for applying a bias voltage to a developer, and said control means controls the bias voltage.

7. An apparatus according to claim 1, wherein said first processing means includes means for applying an electric field to said first member, and said control means controls said electric field applying means.

8. An apparatus according to claim 1, wherein said second processing means includes means for applying an electric charge to said second member before the formation of the secondary latent image, and said control means controls said electric charge applying means.

9. An image forming apparatus comprising:

(a) first and second electrically chargeable members;

(b) means for forming a primary electrostatic latent image on said first chargeable member;

(c) means for forming a secondary electrostatic latent image on said second chargeable member in accordance with said primary electrostatic latent image;

(d) means for developing said secondary electrostatic latent image;

(e) means for detecting a predetermined limit of repetitive formations of the secondary electrostatic latent image based on said primary electrostatic latent image; and (f) control means for stopping the repetitive formation of the secondary electrostatic latent image in response to an output from said detecting means.

10. The image forming apparatus as claimed in claim 9, wherein said control means effects formation of the primary electrostatic latent image after stoppage of the secondary electrostatic latent image formation.

11. An image forming apparatus comprising:

(a) a member bearing an original electrostatic image;

(b) means for repetitively forming a plurality of latent images on a recording member in accordance with said original image;

(c) means for developing the latent image;

(d) means for detecting a visible image forming capability of said original image; and (e) means for controlling, in response to an output from said detecting means, a supply of developer in said developing means so that a developed image of a predetermined image density may be formed.

12. An image forming apparatus comprising:

(a) an electrically chargeable member;

(b) means for forming an electrostatic latent image on said chargeable member, said latent image forming means being provided with ion current modulating means to modulate an ion current directed toward said chargeable member and to form the latent image;

(c) means for developing the electrostatic latent image on said chargeable member;

(d) means for detecting said ion current, said detecting means being provided on said modulating means; and (e) means for controlling, by said detecting means, at least one of said electrostatic latent image forming means and said developing means to provide a developed image having a predetermined image density.

13. The image forming apparatus as claimed in claim 12, wherein said latent image forming means is provided with a charger for applying a preliminary corona charge to said chargeable member, and said control means controls said charger.

14. The image forming apparatus as claimed in claim 12, wherein said control means controls the ion current which contributes to modulation.

15. The image forming apparatus as claimed in claim 12, wherein said developing means is provided with means for regulating adherence of toner to the latent image, and said control means control said regulating means.

16. The image forming apparatus as claimed in claim 12, wherein said modulating means is provided with a screen having thereon a latent image, and said detecting means is provided between said screen and a point of ground potential of said apparatus.

17. An image forming apparatus comprising:

(a) an electrically chargeable rotatable member;

(b) processing means for forming electrostatic latent images on said chargeable member and for developing the latent images into visible images on said member;

(c) means for detecting an electrostatic state of said chargeable member and for producing signals which correspond to said detected electrostatic state;

(d) means for controlling said processing means, in response to a first signal from said detecting means, so that visible images of a predetermined density may be formed;

(e) means for storing said first signal at least during one rotation of said chargeable member; and (f) means for making said detecting means carry out a second detection of the electrostatic state of said chargeable member after said one rotation of said chargeable member, and for producing a second signal which corresponds to the electrostatic state thereof at the second detection; said control means having means for comparing said second signal with said stored signal and for controlling said processing means in accordance with an output from said comparing means to provide a predetermined density of images.

18. The image forming apparatus as claimed in claim 17, wherein said detecting means detects a sample of modulating ion current for the latent image formation.

19. The image forming apparatus as claimed in claim 17, wherein said control means is provided with means for holding a peak potential or an average potential of the latent image.

20. An apparatus according to claim 17, wherein said control means cancels said stored signal after the formation of a preset number of latent images having the same image pattern.

21. An apparatus according to claim 17, wherein said stored signal corresponds to an initial image, said control means includes another storing means for holding a signal produced by said detecting means which corresponds to the visible image forming capability of an electrostatic latent image other than said initial image, and said control means produces an output on the basis of a comparison between the initial stored signal and the signal of said another storing means.

22. An image forming apparatus comprising:

(a) an image bearing member;

(b) processing means for forming latent images on said image bearing member and developing the latent images into visible images;

(c) means for detecting visible image forming capabilities of the latent images and producing signals which correspond to the detected visible image forming capabilities;

(d) means for comparing a first visible image forming capability signal of said detecting means with a reference signal, and means for setting the reference signal in accordance with a second visible image forming capability signal of said detecting means; and (e) means for controlling the operation of said processing means in accordance with said compared signals to provide a predetermined density of visible images.

23. An apparatus according to claim 22, wherein said second visible image forming capability signal is that of a sample latent image which is formed prior to formation of plural latent images having the same image pattern.

24. An apparatus according to claim 22, wherein said first visible image forming capability signal is re-formed with relation to each repeatedly formed latent image having the same image pattern.

25. An apparatus according to claim 22, wherein said reference signal is stored during the formation of the latent images having the same image pattern.

26. An apparatus according to claim 22, wherein said detecting means detects the visible image forming capability of a sample latent image before forming a latent image of an original to be copied.

27. An image forming apparatus comprising:

(a) an image bearing member;

(b) processing means for forming latent images on said image bearing member and developing the latent image into visible images;

(c) first detecting means for detecting the visible image forming capability of a sample latent image formed at a predetermined time before execution of an initial latent image formation process;

(d) second detecting means for detecting the visible image forming capability of another sample latent image which is formed at a predetermined time after execution of the initial latent image formation process; and (e) means for controlling said processing means in accordance with outputs from said first and second detecting means.

28. An image forming apparatus comprising:

an electrically chargeable member;

processing means for forming an electrostatic latent image on said chargeable member and developing the latent image;

first detecting means for detecting a visible image forming capability of the electrostatic latent image, and for producing a signal which corresponds to said detected capability;

means for storing the signal produced by said first detecting means;

first control means for controlling said processing means so as to provide a predetermined density of the visible image;

second detecting means for detecting at least one of an abnormal voltage or current of a signal produced by said first control means; and second control means, responsive to said storing means and said second detecting means for controlling the operation of said first control means.

29. An apparatus according to claim 28, wherein said second control means deactivates the control of said processing means by said first control means.

30. An image forming apparatus comprising:

(a) first and second electrically chargeable members;

(b) first processing means for forming a primary electrostatic latent image on said first chargeable member in accordance with an original image;

(c) second processing means for forming a plurality of secondary electrostatic latent images on said second chargeable member based on said primary electrostatic latent image and forming visualized images based on said secondary electrostatic latent images on transfer materials;

(d) means for detecting visible image forming capabilities of one of the secondary electrostatic latent images; and (e) means for controlling at least one of said first and said second processing means so as to provide a predetermined density of the visualized images.

31. An image forming apparatus comprising:

(a) a member bearing a first latent image;

(b) means for repeatedly forming second latent images on a recording member based on said first latent image and form-visualized images, based on said second latent images, on transfer materials;

(c) means for detecting a visible image forming capability of said first or second latent images;

(d) means for applying a voltage to the transfer materials; and (e) means for controlling said voltage, in accordance with an output of said detecting means, to provide a predetermined image density on the transfer material.

32. An image forming method, comprising:

(a) forming a first electrostatic latent image on a first electrically chargeable member;

(b) detecting a visible image forming capability of said first latent image;

(c) forming a second electrostatic latent image on a second electrically chargeable member in accordance with said first latent image, developing said second electrostatic latent image, and transferring the developed image onto an image transfer material; and (d) in response to the results of detecting said image forming capability of said first latent image, controlling at least one of said second electrostatic latent image formation, said image development, and said image transfer so that a transferred image of a predetermined density may be obtained.

33. In an image forming method, wherein an electrostatic latent image is formed on an electrically chargeable member by ion modulation, and a visible image is formed on said chargeable member from said latent image, a method for controlling such image formation, characterized in that at least one of said latent image formation and visible image formation is controlled in response to the detection of changes in said ion current, to obtain a visible image of a predetermined density.

34. A method for controlling image formation comprising the steps of:

(a) detecting at a first timing an electrostatic state of a chargeable rotatable member;

(b) rotating said chargeable member at least one rotation, after the detection, during which an image forming process is controlled in accordance with the result of the first detection, so as to obtain a visible image of a predetermined density;

(c) storing a signal corresponding to the result of the first detection during said at least one rotation of said chargeable member;

(d) detecting at a second timing, after said at least one rotation, the electrostatic state of a chargeable member; and (e) controlling the processing condition for the image formation in response to the stored signal and the result of the second detection.

35. An image forming method comprising:

(a) a first step for forming a first latent image on a first recording member;

(b) a second step for detecting a visible image forming capability of said first latent image;

(c) a third step for repetitively forming a second latent image in accordance with said first latent image on a second recording member; and (d) a fourth step for ceasing the second latent image formation when the visible image forming capability of the first latent image reaches a predetermined limit, and for executing re-formation of the first latent image.

* * * * *

UNITED STATES PATENT AND TRADEMARK OFFICE

CERTIFICATE OF CORRECTION

PATENT NO. : 4,219,271

DATED : August 26, 1980

INVENTOR(S) : MASAHARU OHKUBO, ET AL.

It is certified that error appears in the above-identified patent and that said Letters Patent are hereby corrected as shown below:

IN THE ABSTRACT

Line 6, change "of" to read --on--.

Line 12, before "electrostatic" insert --the--.

Column 1

Line 41, after "disclosures" insert --mention--.

Line 56, change "takes" to read --take--.

Column 2

Line 46, change "lack" to read --lacking--.

Column 3

Line 52, after "ion" insert --flow--.

Column 5

Line 39, change "set" to read --sets--.

UNITED STATES PATENT AND TRADEMARK OFFICE

CERTIFICATE OF CORRECTION

PATENT NO. : 4,219,271

DATED : August 26, 1980

INVENTOR(S) : MASAHARU OHKUBO, ET AL.

It is certified that error appears in the above-identified patent and that said Letters Patent are hereby corrected as shown below:

Column 7

Line 7, change "takes" to read --take--.

Column 8

Line 60, change "minimum" to read --minimally--.

Column 11

Line 28, change "is" to read --are--.

Column 12

Line 13, change "have" to read --has--.

Line 17, change "is" to read --are--.

Column 13

Line 1, change "is" to read --are--.

UNITED STATES PATENT AND TRADEMARK OFFICE

CERTIFICATE OF CORRECTION

PATENT NO. : 4,219,271

DATED : August 26, 1980

INVENTOR(S) : MASAHARU OHKUBO, ET AL.

It is certified that error appears in the above-identified patent and that said Letters Patent are hereby corrected as shown below:

Column 13

Line 27, change "by" to read --to--.

Lines 34-35, change "portion" to read --proportional--.

Column 14

Lines 25 and 28, change "revolution" to read --revolutions--.

Line 37, before "perfect" insert --to be--.

Column 15

Line 24, change "form" to read --forming--.

Column 16

Line 20, change "exactly" to read --exact--.
Line 64, change "at a" to read --at an--.

UNITED STATES PATENT AND TRADEMARK OFFICE

CERTIFICATE OF CORRECTION

PATENT NO. : 4,219,271

DATED : August 26, 1980

INVENTOR(S) : MASAHARU OHKUBO, ET AL.

It is certified that error appears in the above-identified patent and that said Letters Patent are hereby corrected as shown below:

Column 17

Line 41, change "resulted" to read --resulting--.

Line 44, change "a limit" to read -- limited--.

Line 67, change "is generally restricted to read --generally restricts--.

Column 20

Line 12, delete ", or else".

Line 63, change "resulted" to read --resulting--.

Column 21

Line 21, delete "to".

Line 24, change "other" to read --another--.

Column 22

Line 18, change "A" to read --The--.

UNITED STATES PATENT AND TRADEMARK OFFICE

CERTIFICATE OF CORRECTION

PATENT NO. : 4,219,271

DATED : August 26, 1980

INVENTOR(S) : MASAHARU OHKUBO, ET AL.

It is certified that error appears in the above-identified patent and that said Letters Patent are hereby corrected as shown below:

Column 22

Line 56, after "following" insert --,--.

Colun 23

Lines 43-44, change "following" to read --flowing--.

Line 55, change "sheet" to read --sheets--.

Column 25

Line 38, change "resolution" to read --resolutions--.

Column 26

Line 26, change "voltages" to read --voltage--.

Line 60, change "sample" to read --samples--.

Column 27

Line 15, change "change" to read --charge--.

Line 46, change "assume" to read --assumes--.

UNITED STATES PATENT AND TRADEMARK OFFICE

CERTIFICATE OF CORRECTION

PATENT NO. : 4,219,271

DATED : August 26, 1980

INVENTOR(S) : MASAHARU OHKUBO, ET AL.

It is certified that error appears in the above-identified patent and that said Letters Patent are hereby corrected as shown below:

Column 27

Lines 67-68, delete "meant by that can be".

Signed and Sealed this

*Seventh* Day of *April 1981*

[SEAL]

*Attest:*

RENE D. TEGTMEYER

*Attesting Officer* *Acting Commissioner of Patents and Trademarks*